US005392103A

United States Patent [19]

Kukimoto et al.

[11] Patent Number: 5,392,103

[45] Date of Patent: Feb. 21, 1995

[54] IMAGE FORMING METHOD COMPRISING ELECTROSTATIC TRANSFER OF DEVELOPED IMAGE AND CORRESPONDING IMAGE FORMING APPARATUS

[75] Inventors: Tsutomu Kukimoto, Tokyo; Hiroshi Yusa, Yokohama; Koichi Tomiyama, Kawasaki; Tsuyoshi Takiguchi, Yokohama; Eiichi Imai, Narashino; Tetsuya Kuribayashi, Tokyo; Hisayuki Ochi; Hiroyuki Suematsu, both of Yokohama, all of Japan

[73] Assignee: Canon Kabushiki Kaisha, Tokyo, Japan

[21] Appl. No.: 145,702

[22] Filed: Nov. 4, 1993

Related U.S. Application Data

[60] Division of Ser. No. 902,808, Jun. 25, 1992, Pat. No. 5,270,770, which is a continuation of Ser. No. 514,314, Apr. 25, 1990, abandoned.

[30] Foreign Application Priority Data

| | | | |
|---|---|---|---|
| Apr. 27, 1989 | [JP] | Japan | 1-111006 |
| Jul. 19, 1989 | [JP] | Japan | 1-184421 |
| Jul. 19, 1989 | [JP] | Japan | 1-184422 |

[51] Int. Cl.[6] ..... G03G 15/08

[52] U.S. Cl. ..... 355/274; 355/245; 430/106.6

[58] Field of Search ..... 355/271, 274, 277, 279, 355/245, 211, 210, 202, 251, 253; 430/111, 106.6, 107

[56] References Cited

U.S. PATENT DOCUMENTS

| | | | |
|---|---|---|---|
| 3,942,979 | 3/1976 | Jones et al. | 96/1 |
| 4,150,181 | 4/1979 | Smith | 427/444 |
| 4,162,843 | 7/1979 | Inoue et al. | 355/277 X |
| 4,257,699 | 3/1981 | Lentz | 430/99 X |
| 4,284,701 | 8/1981 | Abbott et al. | 430/111 |
| 4,299,900 | 11/1981 | Mitsuhashi et al. | 430/122 |
| 4,514,485 | 4/1985 | Ushiyama et al. | 430/106.6 |
| 4,568,625 | 2/1986 | Uchiyama et al. | 430/110 |
| 4,728,983 | 3/1988 | Zwadlo et al. | 355/274 X |
| 4,818,242 | 4/1989 | Burmeister et al. | 8/115.6 |
| 4,820,603 | 4/1989 | Sakashita | 430/106.6 |
| 4,906,548 | 3/1990 | Uchide et al. | 430/126 |
| 4,910,558 | 3/1990 | Giezeman et al. | 355/279 |
| 4,910,558 | 3/1990 | Giezeman et al. | 355/279 |
| 4,935,325 | 6/1990 | Kuribayashi et al. | 430/106.6 |
| 4,957,840 | 9/1990 | Sakashita et al. | 430/106.6 |
| 5,041,351 | 8/1991 | Kitamori et al. | 430/106.6 |
| 5,066,485 | 11/1991 | Brieva et al. | 424/63 |
| 5,143,722 | 9/1992 | Hollenberg et al. | 424/63 |
| 5,307,122 | 4/1994 | Ohno et al. | 355/245 |

FOREIGN PATENT DOCUMENTS

| | | | |
|---|---|---|---|
| 0318078 | 5/1989 | European Pat. Off. | 355/277 |
| 0081681 | 4/1987 | Japan | 355/279 |
| 0242978 | 10/1987 | Japan | 325/279 |
| 0286879 | 11/1989 | Japan | 355/276 |
| 2114310 | 10/1987 | United Kingdom . | |

OTHER PUBLICATIONS

*Xerox Disclosure Journal*, "High Frequency Pulse Bias Roller Transfer", Fletcher.

*Primary Examiner*—A. T. Grimley
*Assistant Examiner*—Thu Dang
*Attorney, Agent, or Firm*—Fitzpatrick, Cella, Harper & Scinto

[57] ABSTRACT

An image forming method, including the steps of: developing an electrostatic image formed on an electrostatic image-bearing member with a developer to form thereon thereon a developed image, the developer containing 100 wt. parts of a toner and 0.05 to 3 wt. parts of fine powder treated with a silicone oil or silicone varnish; and transferring the developed image on the electrostatic image-bearing member to a transfer material while causing a transfer device, such as a roller or belt to contact the electrostatic image-bearing member by the medium of the transfer material under a line pressure of 3 g/cm or higher.

20 Claims, 6 Drawing Sheets

IMAGE FORMING METHOD COMPRISING ELECTROSTATIC TRANSFER OF DEVELOPED IMAGE AND CORRESPONDING IMAGE FORMING APPARATUS

This application is a division of application Ser. No. 07/902,808, filed Jun. 25, 1992, now U.S. Pat. No. 5,270,770, which is a continuation of application Ser. No. 514,314, filed Apr. 25, 1990, now abandoned.

FIELD OF THE INVENTION AND RELATED ART

The present invention relates to an image forming method and an image forming apparatus, wherein a transfer device is caused to contact an electrostatic latent image-bearing member by the medium of a transfer material (or transfer-receiving material) and a magnetic toner image formed on the electrostatic latent image-bearing member is transferred to the transfer material.

As image forming apparatus wherein a toner image formed on a latent image-bearing member is electrostatically transferred to a transfer material in a sheet form such as paper, there have been proposed devices wherein a latent image-bearing member in the form of a rotary cylinder, an endless belt, etc., is used, a transfer device provided with a bias is caused to contact such a latent image-bearing member under pressure, and a transfer material is passed between these members, whereby the toner image on the latent image-bearing member is transferred to the transfer material, as disclosed in, e.g., Japanese Laid-Open Patent Application (JP-A, KOKAI) No. 46664/1984.

In such a device, when the contact pressure between a transfer roller and the latent image-bearing member is appropriately regulated, the region in which the transfer material contacts to the latent image-bearing member may be extended, as compared with a transfer means utilizing corona discharge which has heretofore been used widely. Further, since the transfer material is positively supported under pressure in the transfer position, the above-mentioned device is less liable to cause transfer deviation due to synchronism failure caused by a transfer material-conveying means, or due to loop or curl present in the transfer material. As a result, the above-mentioned device may easily meet the demand for shortening the conveying path for the transfer material and for miniaturizing the latent image-bearing member along with the miniaturization of an image forming apparatus.

On the other hand, in the device for effecting the transfer operation which is capable of causing a transfer means to contact a latent image-bearing member by the medium of a transfer material, since a transfer current is supplied to the transfer material in the contact position, it is necessary to apply a certain pressure to the transfer device. When such a contact pressure is applied to the transfer material, the pressure is also applied to the toner image formed on the latent image-bearing member, whereby the toner particles constituting the toner image tend to agglomerate.

Further, in a case where the surface portion of the latent image-bearing member comprises a resin, the above-mentioned toner agglomerates are liable to closely adhere to the latent image-bearing member and the transfer of the toner to the transfer material may be inhibited. In an extreme case, toner particles corresponding to a portion showing strong adhesion are not transferred at all, whereby the resultant toner image is liable to be lacking.

Such a phenomenon is particularly noticeable in a line image portion having a width of 0.1–2 mm. Since a so-called "edge phenomenon (or edge effect)" may occur in the line image portion, a larger amount of toner particles are attached thereto, whereby the agglomeration of toner particles due to pressure and image defects due to transfer operation are liable to occur. When such a phenomenon occurs, the resultant toner image becomes a copied image wherein toner particles are only attached to the contour portion thereof. Such a phenomenon is referred to as "partially white image (e.g., hollow character)". FIGS. 1B and 1D show examples of the partially white image.

The partially white images are particularly liable to occur in the case of thick paper of above 100 g/cm$^2$, a film for OHP (overhead projector) having high smoothness, or second-side copying operation in double-side copying, etc. In the case of the thick paper or OHP film, it is considered that since the transfer material is thick, the effect of the transfer electric field is weakened and the pressure becomes strong, whereby the partially white images are liable to occur. In the case of the second copying in double-side copying, it is considered that a release agent for prevention of offset phenomenon is attached to a transfer material from a fixing device when the transfer material is passed between the fixing device at the time of the first-side copying, and the release agent prevents the close adhesion between the toner particles and transfer material at the time of the second-side transfer operation, whereby partially white images are liable to occur.

As described hereinabove, when a transfer device utilizing a contact member is used, it has many advantages such as miniaturization and small power consumption, but conditions for the transfer materials become severer.

Recently, as image forming apparatus such as electrophotographic copying machines have widely been used, their uses have also extended in various ways, and higher image quality has been demanded. For example, when original images such as general documents and books are copied, it is demanded that even minute letters are reproduced extremely finely and faithfully without thickening or deformation, or interruption. However, in ordinary image forming apparatus such as copying machines for plain paper, when the latent image formed on a photosensitive member thereof comprises thin-line images having a width of 100 microns or below, the reproducibility in thin lines is generally poor and the clearness of line images is still insufficient.

Particularly, in recent image forming apparatus such as electrophotographic printer using digital image signals, the resultant latent picture is formed by a gathering of dots with a constant potential, and the solid, half-tone and highlight portions of the picture can be expressed by varying densities of dots. However, in a state where the dots are not faithfully covered with toner paraticles and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic.

On the other hand, in image forming apparatus such as electrophotographic copying machine, there sometimes occurs a phenomenon such that good image quality is obtained in an initial stage but it deteriorates as the copying or print-out operation is successively conducted. The reason for such a phenomenon may be considered that only toner particles which are more contributable to the developing operation are consumed in advance as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3,942,979, 3,969,251 and 4,112,024) has proposed a non-magnetic toner wherein the particle size distribution is regulated so as to improve the image quality. This toner comprises relatively coarse particles and predominantly comprises toner particles having a particle size of 8–12 microns. However, according to our investigation, it is difficult for such particle size to provide uniform and dense cover-up of the toner particles to a latent image. Further, the above-mentioned toner has a characteristic such that it contains 30% by number or less of particles of 5 microns or smaller and 5% by number or less of particles of 20 microns or larger, and therefore it has a broad particle size distribution which tends to decrease the uniformity in the resultant image. In order to form a clear image by using such relatively coarse toner particles having a broad particle size distribution, it is necessary that the gaps between the toner particles are filled by thickly superposing the toner particles thereby to enhance the apparent image density. As a result, there arises a problem that the toner consumption increases in order-to obtain a prescribed image density.

Japanese Laid-Open Patent Application No. 72054/1979 (corresponding to U.S. Pat. No. 4,284,701) has proposed a non-magnetic toner having a sharper particle size distribution than the above-mentioned toner. In this toner, particles having an intermediate weight has a relatively large particle size of 8.5–11.0 microns, and there is still room for improvement as a toner for a high resolution.

Japanese Laid-Open Patent Application No. 129437/1983 (corresponding to British Patent No. 2114310) has proposed a non-magnetic toner wherein the average particle size is 6–10 microns and the mode particle size is 5–8 microns. However, this toner only contains particles of 5 microns or less in a small amount of 15% by number or below, and it tends to form an image without sharpness.

Further, U.S. Pat. No. 4,299,900 has proposed a jumping developing method using a developer containing 10–50 wt. % of magnetic toner particles of 20–35 microns. In this method, the particle size distribution of the toner is improved in order to triboelectrically charge the magnetic toner, to form a uniform and thin toner layer on a sleeve (developer-carrying member), and to enhance the environmental resistance of the toner. However, at present, further improvements in developing and transfer steps have been demanded.

SUMMARY OF THE INVENTION

An object of the present invention is to provide an image forming method and apparatus which have solved the above-mentioned problems encountered in the prior art.

Another object of the present invention is to provide an image forming method and apparatus utilizing an electrostatic pressure transfer method such as contact transfer method, which has a transfer step capable of providing high-quality images faithful to a latent image regardless of transfer conditions and transfer materials.

A further object of the present invention is to provide an image forming method and apparatus wherein the above-mentioned partially white images are obviated or suppressed.

A further object of the present invention is to provide an image forming method and apparatus capable of providing high-quality images without a partially white image, even when a transfer material such as thick paper is used.

A further object of the present invention is to provide an image forming method capable of constantly exhibiting good performances stably, even under environmental change such as high temperature—high humidity and low temperature—low humidity conditions.

According to the present invention, there is provided an image forming method, comprising:

developing an electrostatic image formed on an electrostatic image-bearing member with a developer to form thereon a developed image, the developer comprising 100 wt. parts of a toner and 0.05 to 3 wt. parts of fine powder treated with a silicone oil or silicone varnish; and transferring the developed image on the electrostatic image-bearing member to a transfer material while causing a transfer means to contact the electrostatic image-bearing member by the medium of the transfer material under a line pressure of 3 g/cm or higher.

The present invention also provides an image forming apparatus comprising:

an electrostatic image-bearing member for carrying an electrostatic image;

means for developing the electrostatic image comprising a toner-carrying member, wherein the toner-carrying member carries thereon a developer comprising 100 wt. parts of a toner and 0.05 to 3 wt. parts of fine powder treated with a silicone oil or silicone varnish; and transfer means for transferring a developed image developed with the developer from the electrostatic image-bearing member to a transfer material while causing the transfer means to contact the electrostatic image-bearing member by the medium of the transfer material under a line pressure of 3 g/cm or higher.

The present invention further provides a facsimile comprising an image forming apparatus and receiving means for receiving image information from a remote terminal; the image forming apparatus comprising:

an electrostatic image-bearing member for carrying an electrostatic image;

means for developing the electrostatic image comprising a toner-carrying member, wherein the toner-carrying member carries thereon a developer comprising 100 wt. parts of a toner and 0.05 to 3 wt. parts of fine powder treated with a silicone oil or silicone varnish; and transfer means for transferring a developed image developed with the developer from the electrostatic image-bearing member to a transfer material while causing the transfer means to contact the electrostatic image-bearing member by the medium of the transfer material under a line pressure of 3 g/cm or higher.

These and other objects, features and advantages of the present invention will become more apparent upon a consideration of the following description of the preferred embodiments of the present invention taken in conjunction with the accompanying drawings.

DETAILED DESCRIPTION OF THE INVENTION

We have found that satisfactory results may be obtained by conducting a transfer step wherein a developer obtained by mixing a toner and fine powder such as silica surface-treated with a silicone oil or silicone varnish is used in combination with a transfer device wherein a transfer material and a latent image-bearing member are caused to contact a transfer member under a line pressure of 3 g/cm or higher.

The contact pressure used in the present invention may preferably be 3 g/cm or higher in terms of line pressure. The line pressure may be calculated according to the following formula:

Line pressure (g/cm)=[Total pressure (g)]/[Length of contact area (cm)]

The above-mentioned contact area is an area in which a transfer material contacts the transfer member constituting a transfer device, and the length thereof is measured in a direction perpendicular to the moving direction of the transfer material.

When the above-mentioned contact pressure is below 3 g/cm, a deviation in conveyance of the transfer material or transfer failure may undesirably occur. In the present invention, the contact pressure may more preferably be 20 g/cm or higher, particularly preferably 25–80 g/cm.

Figure 2:
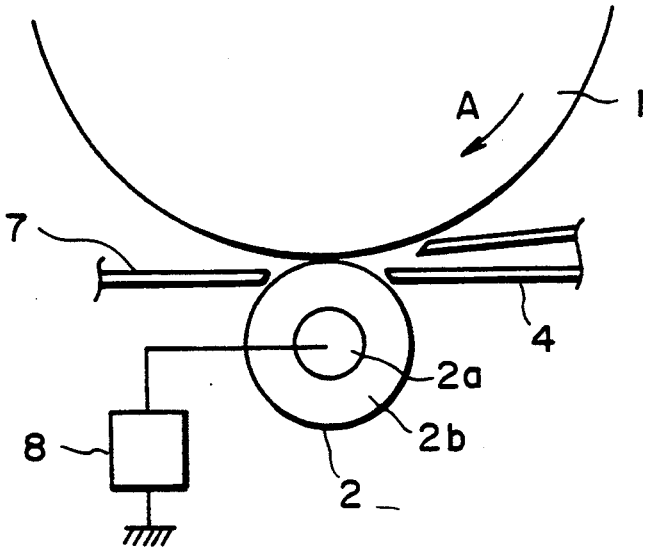
FIGS. 2 and 3 are partial schematic sectional views each illustrating a device used for a transfer step.
Figure 3:
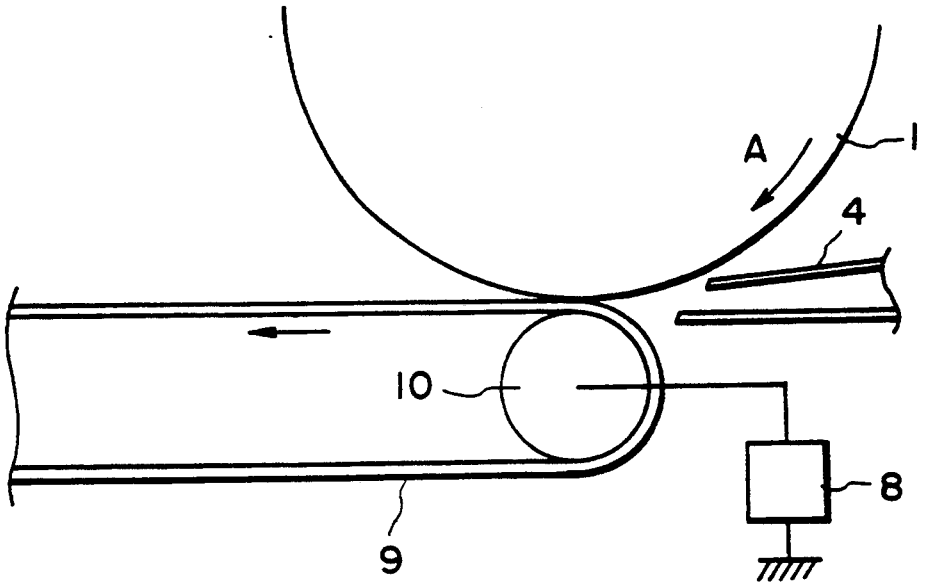

In the present invention, the transfer device may be a transfer roller as shown in FIG. 2, or a transfer belt as shown in FIG. 3.

FIG. 2 is a schematic side sectional view showing an important part of a typical embodiment of the image forming apparatus according to the present invention. The device shown in FIG. 2 comprises a cylindrical latent image-bearing member (hereinafter, referred to as "photosensitive member") 1 extending along with a direction perpendicular to the drawing plane and rotating in the arrow A direction, and an electroconductive transfer roller 2 disposed in contact with the photosensitive member 1.

In the apparatus as shown in FIGS. 2 and 3, along the peripheral surface of the photosensitive member 1 as a latent image-bearing member, there are disposed unshown members to be used for image formation. Specific examples thereof may include: a primary charger for uniformly charging the surface of the photosensitive member 1; an exposure portion for supplying a light image comprising a laser light modulated according to an predetermined image, or reflection light obtained from an original image, to the charged surface of the photosensitive member 1 to decrease the potential of the exposed portion thereby to form an electrostatic latent image on the photosensitive member 1; a developing device; the above-mentioned transfer device 2; and a cleaner for removing a residual toner remaining on the photosensitive member surface after the transfer operation. The above-mentioned members may be disposed in this order along the moving direction of the photosensitive member 1.

The transfer roller 2 comprises a metal core 2*a* and an electroconductive elastic (or elastomeric) layer 2*b* disposed thereon. The electroconductive elastic layer 2*b* may comprises an elastic (an elastomeric) material such as polyurethane-type resin and ethylene-propylene-diene ternary copolymer (EPDM) having a volume resistivity of $10^6$ to $10^{10}$ ohm.cm, and an electroconductive material such as carbon dispersed therein. A bias may be applied to the metal core 2*a* by means of a constant-voltage supply 8. With respect to the bias conditions, a current of 0.1–50 $\mu$A and a voltage (absolute value) of 100–5000 V (more preferably 500–4000 V) may preferably be used. In order to apply a pressure to the transfer roller 2, a pressure may generally be applied to bearings (not shown) supporting both ends of the metal core 2*a*.

FIG. 3 shows an embodiment of the present invention using a transfer belt 9. The transfer belt 9 may be supported and driven by an electroconductive roller 10.

The present invention is particularly preferably applied to an image forming apparatus comprising an electrostatic image-bearing member of which surface portion comprises an organic compound such as resin.

When the surface layer of the electrostatic image-bearing member comprises an organic compound, a binder resin contained in a toner is liable to adhere to such a surface layer. Particularly, the binder resin and the surface layer comprise materials of the same or similar species, chemical bonds are liable to occur in the contact points between the toner particles and the photosensitive member, thereby to pose a problem such that the transferability of the toner is decreased.

Specific examples of the surface material constituting the electrostatic image-bearing member may include: silicone resins, vinylidene chloride-type resins, ethylene-vinylidene chloride-type resins, styrene-acrylonitrile-type resins, styrene-methyl methacrylate-type resins, styrene-type resins, polyethylene terephthalate resins, polycarbonate resins. However, the resin usable in the present invention is not restricted to these specific examples but there may be used other copolymers of monomers constituting the above-mentioned resin, copolymers of such a monomer and another monomer, or polymer blends of the above-mentioned polymers.

The present invention is particularly effective in the case of an image forming apparatus comprising a photosensitive drum having a diameter of 50 mm or smaller, (more preferably 40 mm or smaller), as the photosensitive member 1.

In the case of a photosensitive drum having a small diameter, since the curvature thereof is larger even under the same line pressure, the pressure is liable to be concentrated in the contact position. Since the same phenomenon may occur in the case of a belt-type photosensitive member, the present invention is also effective in an image forming apparatus comprising a photosensitive member in a belt form having a curvature radius of 25 mm or smaller at the transfer position.

The developer to be used in the present invention contains fine powder treated with a silicone oil or a silicone varnish. The fine powder used in the present invention may preferably have a particle size of 0.001–2 microns, more preferably 0.005–0.2 micron.

The fine powder used in the present invention may preferably comprise an inorganic compound. Preferred examples thereof may include metal oxides containing a metal of group III or IV such as silicic acid (or silica), alumina, and titanium oxide.

In the present invention, it is preferred to use dry-process silica fine powder produced through vapor-phase oxidation of a silicon halide. In the above preparation step, it is also possible to obtain complex fine powder of silica and another metal oxide by using another metal halide compound such as aluminum chloride and titanium chloride together with the silicon halide compound. Such is also included in the fine silica powder to be used in the present invention.

The silicone oil used for the treatment of the fine powder used in the present invention may preferably be one represented by the following formula:

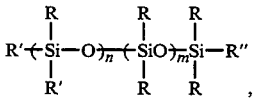

wherein R denotes an alkyl group having 1—3 carbon atoms; R′ denotes a silicone oil-modifying group such as alkyl, halogen-modified alkyl, phenyl, and modified phenyl (i.e., phenyl having a substituent); and R″ denotes an alkyl or alkoxy group having 1–3 carbon atoms.

Specific examples of such a silicone oil may include: dimethylsilicone oil, alkyl-modified silicone oil, α-methylstyrene-modified silicone oil, chlorophenylsilicone oil, fluorine-modified silicone oil, etc. However, the silicone oil usable in the present invention is not restricted to the above-mentioned specific examples.

The above-mentioned silicone oil may preferably be one having a viscosity of 50–1000 centistokes at 25° C. When the viscosity is below 50 centistokes, the silicone oil may partially be evaporated to deteriorate the charging characteristic of silica. When the viscosity exceeds 1000 centistokes, the silicone oil is difficult to be handled in the treatment operation.

In order to effect the silicone oil treatment, known techniques may be used. For example, there may be used: a method wherein fine powder and a silicone oil are mixed by means of a mixer; a method wherein a silicone oil is sprayed on fine powder by means of a sprayer; and a method wherein a silicone oil is dissolved in a solvent and fine powder is mixed in the resultant solution. However, the treating method usable in the present invention is not restricted to these specific examples.

The silicone varnish to be used for treating fine powder in the present invention may be a known material. Specific examples thereof may include commercially available silicone varnishes such as KR-251, and KP-112 (each mfd. by Shinetsu Silicone K.K.). However, the silicone varnish usable in the present invention is not restricted to these specific examples.

In order to effect the silicone varnish treatment, known techniques may be used in the same manner as in the case of the silicone oil.

In the present invention, an amino-modified silicone oil represented by the following structural formula (I) may also be used:

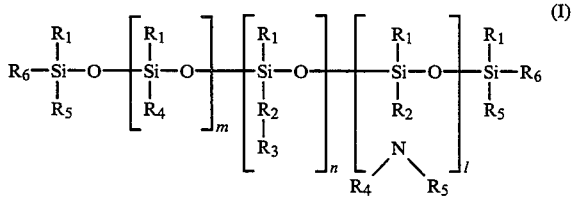

(I)

wherein $R_1$ and $R_6$ respectively denote a hydrogen atom, an alkyl group, an aryl group or an alkoxy group; $R_2$ denotes an alkylene group or a phenylene group; $R_3$ denotes a nitrogen-containing heterocycle or a group having a heterocyclic structure; and $R_4$ and $R_5$ respectively denote a hydrogen atom, an alkyl group or an aryl group; provided that $R_2$ is omissible.

In the formula (I), each of the above-mentioned alkyl, aryl, alkylene, and phenylene groups is capable of having an amino group, and is capable of having a substituent such as halogen atom to an extent wherein the chargeability of silica treated with such a silicone oil is not substantially impaired. In the above formula (I), m denotes a number of 1 or larger, and n and l respectively denote 0 (zero) or a positive number provided that the sum of (n+1) is a positive number of 1 or larger.

In the above formula (I), it is particularly preferred that the number of the nitrogen atom contained in the nitrogen-containing side chain thereof is 1 or 2.

Specific examples of the unsaturated nitrogen-containing heterocycle may include those represented by the following formulas:

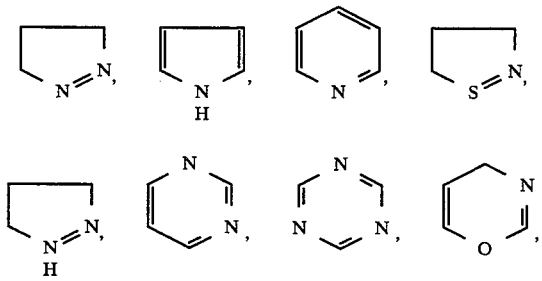

-continued

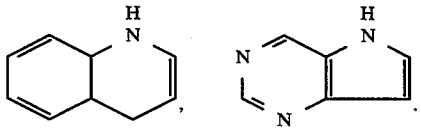

Specific examples of the saturated nitrogen-containing heterocycle may include those represented by the following formulas:

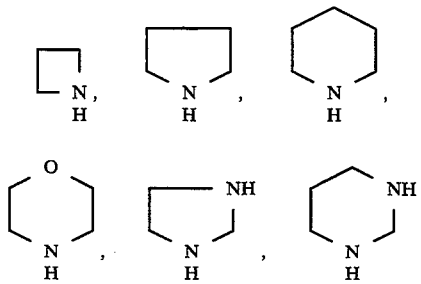

While the present invention is not restricted to the above-mentioned specific examples, a heterocycle having a five- or six-membered ring structure may preferably be used.

In the present invention, the heterocycle may be a derivative thereof such that a functional group such as hydrocarbon group, halogen group, amino group, vinyl group, mercapto group, methacrylic group, glycidoxy group and ureido group is introduced thereto.

The amino-modified silicone oil used in the present invention may preferably have a nitrogen atom equivalent of 10,000 or below, more preferably 300–2,000. The nitrogen atom equivalent used herein is an equivalent weight (g/equiv.) per one nitrogen atom, i.e., a value obtained by dividing the molecular weight by the number of the nitrogen atoms contained in one molecule. These silicone oils may be used singly or as a mixture of two or more species thereof.

The silicone varnish used for providing an amino-modified silicone varnish for fine powder treatment in the present invention may include methylsilicone varnish, phenylmethylsilicone varnish, etc. Among these, methylsilicone varnish is particularly preferred.

The methylsilicone varnish may comprise a polymer comprising the following $T^{31}$ unit, $D^{31}$ unit and $M^{31}$ unit, and may be a three-dimensional polymer comprising a larger amount of the $T^{31}$ unit.

[$T^{31}$ unit]

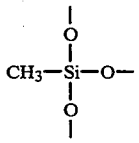

[$D^{31}$ unit]

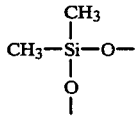

-continued

[$M^{31}$ unit]

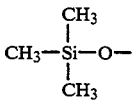

Specific examples of the methylsilicone varnish or phenylsilicone varnish may include those comprising a chemical structure represented by the following formula:

(II)

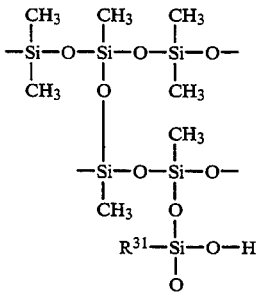

wherein $R^{31}$ denotes a methyl or phenyl group.

In the above-mentioned silicone varnish, the $T^{31}$ unit is particularly effective in imparting thereto good thermosetting property to form a three-dimensional network structure. When fine powder is surface treated with the silicone varnish comprising such a $T^{31}$ unit, the fine particles constituting the fine powder may have a hard and tenacious film on their surfaces, whereby the fine particles are excellent in impact resistance, humidity resistance, and releasability. The above-mentioned $T^{31}$ unit may preferably be contained in the silicone varnish in an amount of 10–90 mol. %, more preferably 30–80 mol. %.

When the $T^{31}$ unit content is too low, the film of the silicone varnish may be softened due to a low-molecular weight component contained therein, to increase its adhesiveness, whereby the humidity resistance, durability or stability in triboelectric chargeability may sometimes be lowered. Further, in some cases, the cleaning property of the toner is deteriorated to cause toner scattering, whereby image unevenness, fog, etc. may occur, and further the durability of a developing device may be decreased.

On the other hand, when the $T^{31}$ unit content is too high, the coating layer to be formed on inorganic fine particles may become uneven and stability in triboelectric chargeability and durability may be deteriorated in some cases.

The silicone varnish may have a hydroxyl group at the end of the molecular chain or in the side chain, and is capable of being cured or hardened due to dehydration condensation based on such a hydroxyl group. Specific examples of the curing promoter for promoting the above-mentioned curing reaction may include: fatty acid salts such as those containing zinc, lead, cobalt and tin; amines such as triethanolamine and butylamine; etc. Among these, an amine is particularly preferred.

In order to convert the above-mentioned silicone varnish to an amino-modified silicone varnish, the methyl or phenyl group contained in the above-mentioned $T^{31}$, $D^{31}$ or $M^{31}$ unit may be partially replaced by an amino group-containing group.

Specific examples of the amino-group-containing group may include those represented by the following formula, but the amino group-containing group usable in the present invention is not restricted to these specific examples.

$-CH_2CH_2-NH_2$
$-CH_2(CH_2)_2-NH_2$
$-CH_2(CH_2)_2-NH-(CH_2)_3-NH_2$ $-CH_2CH_2-NH_2$
$-CH_2(CH_2)_2-NH_2$
$-CH_2(CH_2)_2-NH-(CH_2)_3-NH_2$

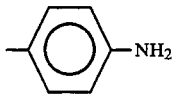

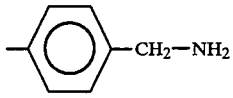

In order to effect the amino-modified silicone varnish treatment, known techniques may be used in the same manner as in the case of the silicone oil.

In the present invention, it is preferred to use 1–35 wt. parts (more preferably 2–30 wt. parts) of the amino-modified silicone oil or amino-modified silicone varnish (based on the solid content thereof) for treatment, with respect to 100 wt. parts of the fine powder.

It is preferred to use 0.05–3 wt. parts (more preferably 0.1–3 wt. parts, particularly preferably 0.6–3 wt. parts) of the fine powder treated with the silicone oil or silicone varnish, with respect to 100 wt. parts of the toner.

When the material of the fine powder comprises silica, the silica may preferably show its effect when added in an amount of 0.1–1.6 wt. parts, and may more preferably show excellent stability when added in an amount of 0.3–1.6 wt. parts, with respect to 100 wt. parts of the toner. When the addition amount is below 0.1 wt. parts, the effect of the addition is small. When the addition amount exceeds 1.6 wt. parts, a problem is liable to occur at the time of developing and fixing operations.

In the present invention, it is more preferred that the fine powder is first treated with a silane coupling agent, and thereafter is treated with a silicone oil or a silicone varnish.

In general, when the fine powder is treated with a silicone oil alone, since the surface of the fine powder is coated with a larger amount of the silicone oil, aggregates of the fine powder are liable to occur in the treatment, and the fluidity of a developer can sometimes be decreased when such fine powder is applied to the developer. Accordingly, it is preferred to pay sufficient attention to the step using the silicone oil. In order to remove fine powder aggregates while retaining good humidity resistance thereof, it is preferred that the fine powder is treated with a silane coupling agent and thereafter treated with a silicone oil so as to sufficiently provide sufficient effect of the treatment with the silicone oil.

The silane coupling agent used in the present invention may preferably be one represented by the following general formula:

$R_mSiY_n$, wherein R denotes an alkoxy group or a chlorine atom; m denotes an integer of 1 to 3; Y denotes a hydrocarbon group comprising an alkyl, vinyl, glycidoxy or methacrylic group; and n denotes an integer of 3 to 1.

Typical examples of such a silane coupling agent may include: dimethyldichlorosilane, trimethylchlorosilane, allyldimethyldichlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, dimethylvinylchlorosilane, etc.

The treatment of the fine powder with the silane coupling agent may be conducted by a dry process wherein fine powder is converted into a cloud state by stirring, etc., and a vaporized silane coupling agent is caused to react with the resultant cloud; or a wet process wherein fine powder is dispersed in a solvent and a silane coupling agent is dripped into the resultant dispersion to be reacted therewith.

The silane coupling agent may preferably be used for treatment in an amount of 1–50 wt. parts, more preferably 5–40 wt. parts, with respect to 100 wt. parts of the fine powder.

In the present invention, the amount of the solid content of the silicone oil or silicone varnish to be used for the treatment may preferably be 1–35 wt. parts, more preferably 2–30 wt. parts, with respect to 100 wt. parts of the fine powder. Such a treating amount is preferred for the following reason.

When the amount of the silicone oil used for treatment is too small, the result of the treatment may be substantially the same as that in the case of the treatment with a silane coupling agent alone, and the humidity resistance is not sufficiently improved, whereby the resultant fine powder can absorb moisture and high-quality copied images are difficult to be obtained under a high-humidity condition. When the amount of the silicone oil used for treatment is too large, the above-mentioned aggregates of fine powder are liable to occur and free silicone oil can also occur in an extreme case. As a result, even when such silica is applied to a developer, there can be posed a problem such that it does not sufficiently improve the fluidity of the developer.

The mechanism of improvement by the fine powder treated with the silicone oil or silicone varnish, in view of the partially white image or hollow character, is not necessarily clear. However, according to our knowledge, it is considered that the releasability of magnetic toner particles from a latent image-bearing member is improved on the basis of low surface energy of the treating agent.

In the present invention, the toner contained in the developer may preferably have a volume-average particle size of 5–13 microns.

In an embodiment of the present invention wherein the toner contained in the developer comprises an insulating magnetic toner and a developing image excellent in image quality is desired, an insulating magnetic toner having a volume-average particle size of 6–8 microns may particularly preferably be used.

It is preferred that the above-mentioned insulating magnetic toner contains 17–60% by number of magnetic toner particles having a particle size of 5 microns or smaller, contains 5–50% by number of magnetic toner particles having a particle size of 6.35–10.08 microns, and contains 2.0% by volume or less of magnetic toner particles having a particle size of 12.70 microns or larger; and the magnetic toner has a volume-average particle size of 6–8 microns, and the magnetic toner particles having a particle size of 5 microns or smaller has a particle size distribution satisfying the following formula:

$$N/V = -0.05N + k,$$

wherein N denotes the percentage by number of magnetic toner particles having a particle size of 5 micron or smaller, V denotes the percentage by volume of magnetic toner particles having a particle size of 5 microns or smaller, k denotes a positive number of 4.6–6.7, and N denotes a positive number of 17–60.

The insulating magnetic toner having the above-mentioned particle size distribution can faithfully reproduce thin lines in a latent image formed on a photosensitive member, and is excellent in reproduction of dot latent images such as halftone dot and digital images, whereby it provides images excellent in gradation and resolution characteristics. Further, such a toner can retain a high image quality even in the case of successive copying or print-out, and can effect good development by using a smaller consumption thereof as compared with the conventional magnetic toner, even in the case of high-density images. As a result, the above-mentioned magnetic toner is excellent in economical characteristics and further has an advantage in miniaturization of the main body of a copying machine or printer.

The reason for the above-mentioned effects of the magnetic toner according to the present invention is not necessarily clear but may assumably be considered as follows.

The magnetic toner according to the present invention may be first characterized in that it contains 17–60% by number of magnetic toner particles of 5 microns or below. Conventionally, it has been considered that magnetic toner particles of 5 microns or below are required to be positively reduced because the control of their charge amount is difficult, they impair the fluidity of the magnetic toner, and they cause toner scattering to contaminate the machine.

However, according to our investigation, it has been found that the magnetic toner particles of 5 microns or below are an essential component to form a high-quality image.

For example, we have conducted the following experiments.

Thus, there was formed on a photosensitive member a latent image wherein the surface potential on the photosensitive member was changed from a large developing potential contrast at which the latent image would easily be developed with a large number of toner particles, to a small developing potential contrast at which the latent image would be developed with only a small number of toner particles.

Such a latent image was developed with a magnetic toner having a particle size distribution ranging from 0.5 to 30 microns. Then, the toner particles attached to the photosensitive member were collected and the particle size distribution thereof was measured. As a result, it was found that there were many magnetic toner particles having a particle size of 8 microns or below, particularly 5 microns or below. Based on such finding, it was discovered that when magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The magnetic toner according to the present invention may be secondly characterized in that it contains 5–50% by number of magnetic toner particles of 6.35–10.08 microns. Such second feature relates to the above-mentioned necessity for the presence of the toner particles of 5 microns or below.

As described above, the toner particles having a particle size of 5 microns or below have the ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion appears to be lower. Particularly, the magnetic toner particles of 5 microns or below strongly have such a tendency. However, we have found that when 5–50% by number of toner particles of 6.35–10.08 microns are contained in a toner, not only the above-mentioned problem can be solved but also the resultant image can be made clearer.

According to our knowledge, the reason for such a phenomenon may be considered that the toner particles of 6.35–10.08 microns have suitably controlled charge amount in relation to those of 5 microns or below, and that these toner particles are supplied to the inner portion of the latent image having a lower field intensity than that of the edge portion thereby to compensate the decrease in cover-up of the toner particles to the inner portion as compared with that in the edge portion, and to form a uniform developed image. As a result, there may be provided a sharp image having a high-image density and excellent resolution and gradation characteristic.

The third feature of the magnetic toner according to the present invention may be that toner particles having a particle size of 5 microns or smaller contained therein satisfy the following relation between their percentage by number (N) and percentage by volume (V):

$$N/N = -0.05N + k,$$

wherein $4.6 \leqq k \leqq 6.7$, and $17 \leqq N \leqq 60$.

Figure 4:
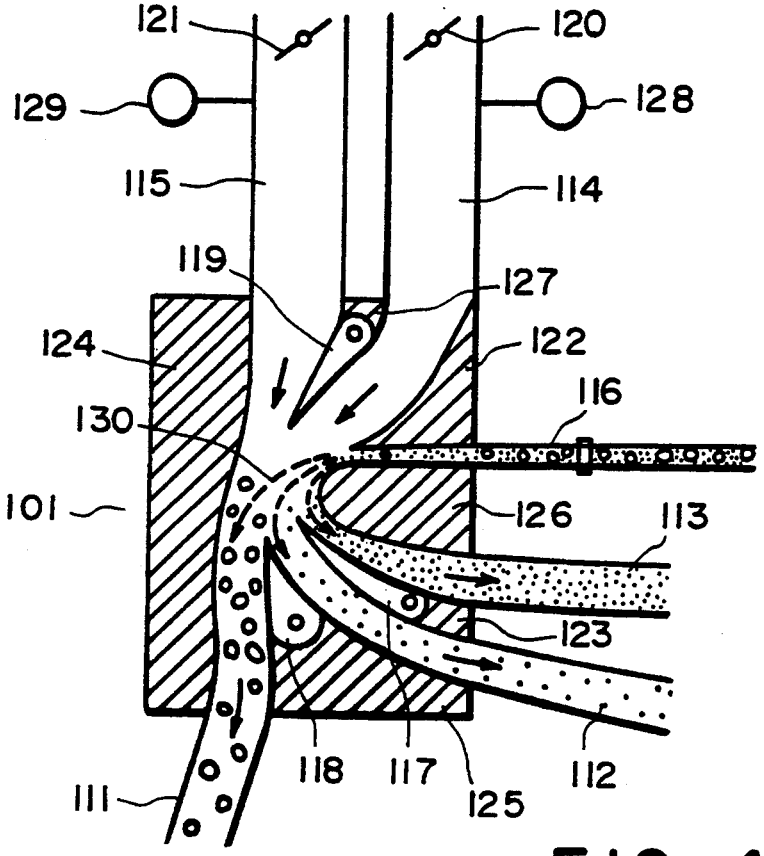
FIGS. 4 and 5 are a front sectional view and a sectional perspective view, respectively, of an apparatus embodiment for practicing multi-division classification.

The region satisfying such a relationship is shown in FIG. 4. The magnetic toner according to this embodiment of the present invention which has the particle size distribution satisfying such a region, in addition to the above-mentioned features, may attain excellent developing characteristic.

According to our investigation on the state of the particle size distribution with respect to toner particles of 5 microns or below, we have found that there is a suitable state of the presence of fine powder in magnetic toner particles. More specifically, in the case of a certain value of N, it may be understood that a large value of N/V indicates that the particles of 5 microns or below are significantly contained, and a small value of N/V indicates that the frequency of the presence of particles near 5 microns is high and that of particles having a smaller particle size is low. When the value of N/V is in the range of 1.6–5.85, N is in the range of 17–60, and the relation represented by the above-mentioned formula is satisfied, good thin-line reproducibility and high resolution are attained.

In the magnetic toner according to the present invention, magnetic toner particles having a particle size of 12.70 microns or larger may be contained in an amount of 2.0% by volume or below. The amount of these particles may preferably be as small as possible.

As described hereinabove, the magnetic toner according to the present invention may solve the problems encountered in the prior art from a viewpoint utterly different from that in the prior art, and can meet the recent severe demand for high image quality.

Hereinbelow, the present invention will be described in more detail.

In this embodiment of the present invention, the magnetic toner particles having a particle size of 5 microns or smaller are contained in an amount of 17–60% by number, preferably 25–60% by number, more preferably 30–60% by number, based on the total number of particles. If the amount of magnetic toner particles is smaller than 17% by number, the toner particles effective in enhancing image quality is insufficient. Particularly, as the toner particles are consumed in successive copying or print-out, the component of effective magnetic toner particles is decreased, and the balance in the particle size distribution of the magnetic toner shown by the present invention is deteriorated, whereby the image quality gradually decreases. On the other hand, the above-mentioned amount exceeds 60% by number, the magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a little low density is liable to occur.

In the magnetic toner according to the present invention, it is preferred that the amount of particles in the range of 6.35–10.08 microns is 5–50% by number, preferably 8–40% by number. If the above-mentioned amount is larger than 50% by number, not only the image quality deteriorates but also excess development (i.e., excess cover-up of toner particles) occurs, thereby to invite an increase in toner consumption. On the other hand, the above-mentioned amount is smaller than 5%, it is difficult to obtain a high image density.

In the present invention, it is preferred that the percentage by number (N %) and that by volume (V %) of magnetic toner particles having a particle size of 5 micron or below satisfy the relationship of $N/V=-0.05N+k$, wherein k represents a positive number satisfying $4.6 \leqq k \leqq 6.7$. The number k may preferably satisfy $4.6 \leqq k \leqq 6.2$, more preferably $4.6 \leqq k \leqq 5.7$. Further, as described above, the percentage N may preferably satisfy $17 \leqq N \leqq 60$, more preferably $25 \leqq N \leqq 60$, particularly preferably $30 \leqq N \leqq 60$.

If $k<4.6$, magnetic toner particles of 5.0 microns or below are insufficient, and the resultant image density, resolution and sharpness may decrease. When fine toner particles in a magnetic toner, which have conventionally been considered useless, are present in an appropriate amount, they attain closest packing of toner in development (i.e., in a latent image formed on a photosensitive drum) and contribute to the formation of a uniform image free of coarsening. Particularly, these particles fill thin-line portions and contour portions of an image, thereby to visually improve the sharpness thereof. If $k<4.6$ in the above formula, such a component becomes insufficient in the particle size distribution, the above-mentioned characteristics may become poor.

Further, in view of the production process, a large amount of fine powder must be removed by classification in order to satisfy the condition of $k<4.6$. Such a process is disadvantageous in yield and toner costs.

On the other hand, if $k>6.7$, an excess of fine powder is present, whereby the resultant image density is liable to decrease in successive copying. The reason for such a phenomenon may be considered that an excess of fine magnetic toner particles having an excess amount of charge are triboelectrically attached to a developing sleeve and prevent normal toner particles from being carried on the developing sleeve and being supplied with charge.

In the magnetic toner according to the present invention, the amount of magnetic toner particles having a particle size of 12.7 microns or larger may preferably be 2.0% by volume or smaller, more preferably 1.0% by volume or smaller, particularly preferably 0.5% by volume or smaller.

If the above amount is larger than 2.0% by volume, these particles can impair thin-line reproducibility.

In the present invention, the volume-average particle size of the toner may preferably be 6–8 microns. This value closely relates to the above-mentioned features of the magnetic toner according to this embodiment. If the volume-average particle size is smaller than 6 microns, there tend to occur problems such that the amount of toner particles transferred to a transfer paper is insufficient and the image density is low, in the case of an image such as graphic image wherein the ratio of the image portion area to the whole area is high. The reason for such phenomenon may be considered the same as in the above-mentioned case wherein the inner portion of a latent image provides a lower image density than that in the edge portion thereof. If the number-average particle size exceeds 8 microns, the resultant resolution is not good and there tends to occur a phenomenon such that the image quality is lowered in successive print-out even when it is good in the initial stage thereof.

While the particle distribution of a toner may be measured by means of a Coulter counter in the present invention, it can be measured in various ways.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg, of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. Form the results of the volume-basis distribution and number-basis distribution, the above-mentioned respective parameters characterizing the magnetic toner.

In the present invention, the true density of the magnetic toner may preferably be 1.45–1.8 g/cm$^3$, more preferably 1.55–1.75 g/cm$^3$. When the true density is in such a range, the magnetic toner having a specific particle size distribution as described above functions most effectively in a reversal development system in the presence of a magnetic field, with respect to high image quality and stability in successive use.

If the true density of the magnetic toner particles is smaller than 1.45, the weight of the particle per se can be too light and there tend to occur reversal fog, deformation of thin lines, and scattering and deterioration in resolution in reversal development because an excess of toner particles are attached to the latent image. On the other hand, if the true density of the magnetic toner is larger than 1.8, there occurs an image wherein the image density is low, thin lines are interrupted, and the sharpness is lacking. Further, because the magnetic force becomes relatively strong in such a case, ears of the toner particles are liable to be lengthened or converted into a branched form. As a result, the image quality is disturbed in the development of a latent image, whereby a coarse image is liable to occur.

In the present invention, the true density of the magnetic toner may be measured in the following manner which can simply provide an accurate value in the measurement of fine powder, although the true density can be measured in other ways.

There are provided a cylinder of stainless steel having an inside diameter of 10 mm and a length of about 5 cm, and a disk (A) having an outside diameter of about 10 mm and a height of about 5 mm, and a piston (B) having an outside diameter about 10 mm and a length of about 8 cm, which are capable of being closely inserted into the cylinder.

In the measurement, the disk (A) is first disposed on the bottom of the cylinder and about 1 g of a sample to be measured is charged in the cylinder, and the piston (B) is gently pushed into the cylinder. Then, a force of 400 $Kg/cm^2$ is applied to the piston by means of a hydraulic press, and the sample is pressed for 5 min. The weight (Wg) of thus pressed sample is measured and the diameter (D cm) and the height (L cm) thereof are measured by means of a micrometer. Based on such measurement, the true density may be calculated according to the following formula:

$$\text{True density } (g/cm^3) = W/(\pi \times (D/2)^2 \times L)$$

In order to obtain better developing characteristics, the magnetic toner used in the present invention may preferably have the following magnetic characteristics: a residual magnetization $\sigma_r$ of 1–5 emu/g, more preferably 2–4.5 emu/g; a saturation magnetization $\sigma_s$ of 15–50 emu/g, preferably 20–40 emu/g and a coercive force Hc of 20–100 Öe, more preferably 40–100 Öe, particularly preferably 40–70 Öe. These magnetic characteristics may be measured under a magnetic field for measurement of 1 KÖe.

The magnetic toner having a particle size as that used in the present invention generally tends to have a larger charge amount and to be agglomerated as compared with the conventionally known toner having a volume-average particle size of 9 microns or larger. Accordingly, as the particle size becomes smaller, it is necessary to add thereto a fluidity improver corresponding to the increase in the surface area. When hydrophobic silica surface-treated with a silicone oil or silicone varnish according to the present invention is used, the fluidity may be improved and further, partially white images (e.g., hollow characters) may be obviated in an image forming method using a transfer charging device disposed in contact with an electrostatic image-bearing member under a contact pressure of 3 g/cm or higher.

In the present invention, it is also preferred to use hydrophobic silica as a fluidity improver in combination with the above-mentioned fine powder surface-treated with the silicone oil or silicone varnish.

Specific examples of the binder for use in constituting the magnetic toner according to the present invention, may include: homopolymers of styrene and its derivatives, such as polystyrene, poly-p-chlorostyrene, and polyvinyltoluene; styrene copolymers, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, polyvinyl acetate, polyethylene, polypropylene, silicone resin, polyester resin, epoxy resin, polyvinylbutyral, rosin, modified rosin, terpene resin, phenolic resins, xylene resin, aliphatic or alicyclic hydrocarbon resins, aromatic petroleum resin, chlorinated paraffin, paraffin wax, etc. These binder resins may be used either singly or as a mixture.

Among these, the binder used in the present invention may preferably comprise a styrene-acrylic resin-type copolymer (inclusive of styrene-acrylic acid ester copolymer and styrene-methacrylic acid ester copolymer). Particularly preferred examples may include: styrene-n-butyl acrylate (St-nBA) copolymer, styrene-n-butyl methacrylate (St-nBMA) copolymer, styrene-n-butyl acrylate-2-ethylhexyl methacrylate copolymer (St-nBA-2EHMA) copolymer in view of the fixing and anti-offset characteristics of the resultant toner in hot roller fixing.

The magnetic toner according to the present invention can also contain a known colorant. Specific examples thereof may include carbon black, copper phthalocyanine, iron black, etc.

The magnetic toner according to the present invention may contain a magnetic material. The magnetic material be incorporated in the toner may be powder of a magnetizable material when placed in a magnetic field inclusive of a metal such as Fe, Ni and Co or an alloy or compound of these metals such as magnetite $\gamma$-$Fe_2O_3$ and ferrite.

The magnetic fine powder may preferably have a BET specific surface area of 2–20 $m^2/g$, more preferably 2.5–12 $m^2/g$; and may preferably have a Mohs hardness of 5–7. The magnetic powder may be used in a proportion of 70–120 wt. parts, per 100 wt. parts of the binder resin.

The toner according to the present invention can also contain a charge controller, as desired Specific examples thereof may include negative charge controllers such as metal salts of monoazo dyes, and complex metal salts of salicylic acid, alkylsalicylic acid, dialkylsalicylic acid, and naphthoic acid.

In the present invention, the hydrophobicity (or wettability) of the silica fine powder may be measured in the following manner, while another methods can be applied with reference to the following method.

A sample in an amount of 0.1 g is placed in a 200 ml-separating funnel equipped with a sealing stopper, and 100 ml of ion-exchanged water is added thereto. The mixture was shaken for 10 min. by a Turbula Shaker Mixer model T2C at a rate of 90 r.p.m. The separating funnel is then allowed to stand still for 10 min. so that a silica powder layer and an aqueous layer are separated from each other, and 20–30 ml of the content is withdrawn from the bottom. A portion of the water is taken in a 10 mm-cell and the transmittance of the thus withdrawn water is measured by a calorimeter (wavelength: 500 nm) in comparison with ion-exchanged water as a blank containing no silica fine powder. The transmittance of the water sample is denoted as the hydrophobicity (wettability) of the silica.

The hydrophobic silica used in the present invention should preferably have a hydrophobicity of 90% or higher, particularly 93% or higher. If the hydrophobicity is below 90%, high-quality images cannot be attained because of moisture absorption by the silica fine powder under a high-humidity condition.

The magnetic toner according to the present invention may generally be prepared in the following manner.

(1) The binder resin and a magnetic material are blended by uniform dispersion by means of a blender such as Henschel mixer together with optionally added a dye or pigment as a colorant.

(2) The above blended mixture is subjected to melt-kneading by using a melt-kneading means such as kneader, extruder, and roller mill.

(3) The kneaded product is coarsely crushed by means of a crusher such as cutter mill and hammer mill and then finely pulverized by means of a micropulverizer such as jet mill.

(4) The finely pulverized product is subjected to classification by means of a classifier such as zigzag classifier, and Elbow Jet Classifier, thereby to provide a magnetic toner according to the present invention.

As another process for producing the magnetic toner according to the present invention, a polymerization process or an encapsulation process can be used. The outline of these processes is summarized hereinbelow.

[Polymerization process]

(1) A monomer composition comprising a polymerizable monomer (and optionally a polymerization initiator and a colorant) may be dispersed into particles in an aqueous dispersion medium.

(2) The particles of the monomer composition are classified into an appropriate particle size range.

(3) The monomer composition particles within a prescribed particle size range after the classification is subjected to polymerization.

(4) After the removal of a dispersant through an appropriate treatment, the polymerized product is filtered, washed with water and dried to obtain a toner.

[Encapsulation process]

(1) A binder resin (and optionally a colorant and magnetic material) is melt-kneaded to form a toner core material in a molten state.

(2) The toner core material is stirred vigorously in water to form fine particles of the core material.

(3) The fine core particles are dispersed in a solution of a shell material, and a poor solvent is added thereto under stirring to coat the core particle surfaces with the shell material to effect encapsulation.

(4) The capsules obtained above are recovered through filtration and drying to obtain a toner.

The developer to be used in the present invention may be obtained by adding fine powder such as hydrophobic silica treated with a silicone oil or silicone varnish to the thus obtained toner, and mixing the fine powder with the toner.

A preferred embodiment of the image forming method or apparatus according to the present invention is described with reference to FIG. 7.

Figure 7:
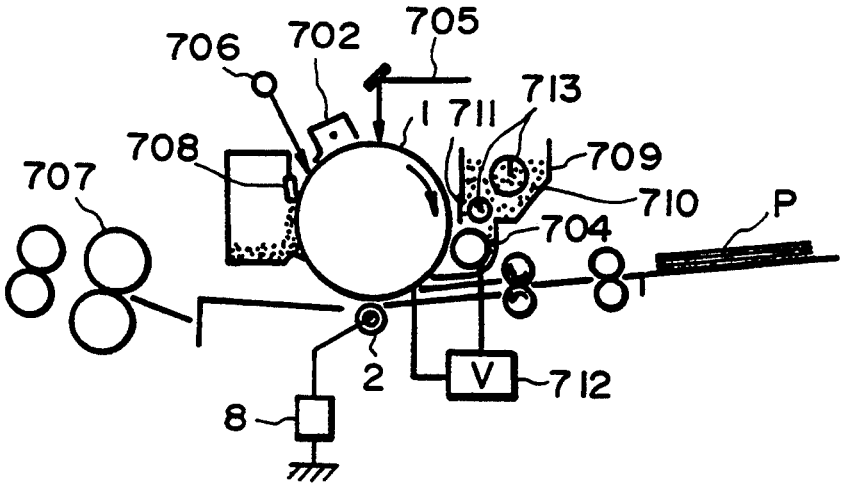
FIG. 7 is a schematic sectional view showing an embodiment of the image forming method and apparatus according to the present invention.

Referring to FIG. 7, the surface of a photosensitive member (drum) 1 is charged negatively by means of a primary charger 702, and then an exposure light 705 comprising laser is supplied to the photosensitive member surface according to an image scanning method thereby to form a digital latent image thereon. The latent image is developed with a one-component magnetic developer 710 to form a toner image in a developing position where a developing sleeve 704 of a developing device 709 is disposed opposite to the photosensitive member surface. The developing device 709 comprises a magnetic blade 711 and the developing sleeve 704 having a magnet 714 inside thereof, and contains the one-component developer 710. In the developing position, a bias comprising an alternating bias, a pulse bias, and/or a DC bias is applied between the electroconductive substrate (not shown) of the photosensitive drum 1 and the developing sleeve 704 by a bias application means 712, as shown in FIG. 7.

As shown in FIG. 7, when a transfer paper P is conveyed to a transfer position where a transfer means 2 confronts the photosensitive drum 1, the back side surface of the transfer paper P (i.e., the surface thereof opposite to that confronting the photosensitive drum 1) is charged by means of a roller-type transfer means 2 and a voltage application means 8, whereby the developed image (i.e., toner image) formed on the photosensitive drum surface is electrostatically transferred to the transfer paper P. Then, the transfer paper P is separated from the photosensitive drum 1, and conveyed to a fixing device 707 using heat and pressure, thereby to fix the toner image to the transfer paper P.

The residual one-component developer remaining on the photosensitive drum 1 downstream of the transfer position is removed by a cleaner 708 having a cleaning blade. The photosensitive drum 1 after the cleaning is discharged by erase exposure 706, and again subjected to the above-mentioned process including the charging step based on the primary charger 702, as the initial step.

Referring again to FIG. 7, the photosensitive drum 1, as an electrostatic image-bearing member, comprises a photosensitive layer and the electroconductive substrate (not shown), and moves in the direction of an arrow shown in FIG. 7. On the other hand, the developing sleeve 704 of a nonmagnetic cylinder, as a developer-carrying member, rotates so as to move in the same direction as that of the photosensitive drum 1 in the developing position. The multipolar permanent magnet (magnetic roller), not shown is disposed inside the nonmagnetic cylinder 704 so as not to rotate.

The one-component insulating magnetic developer 710 contained in the developing apparatus 709 is applied onto the developing sleeve 704, and the toner particles contained therein are supplied with negative triboelectric charge on the basis of the friction between the sleeve 704 surface and the toner particles.

A magnetic doctor blade of iron 711 is disposed close to the sleeve surface (preferably at a clearance of 50–500 microns) and opposite to one of the poles of the multipolar permanent magnet contained in the sleeve 704. Thus, the thickness of the toner layer disposed on the sleeve 704 is regulated uniformly and thinly (preferably in a thickness of 30–300 microns), to form a developer layer having a thickness smaller than the above-mentioned clearance between the photosensitive drum 1 and the sleeve 704 in the developing position so that the developer layer formed on the sleeve 704 does not contact the image bearing member 1. The rotating speed of the sleeve 704 may be regulated so that the speed of the surface thereof is substantially the same as (or close to) the speed of the photosensitive drum 1 surface.

The magnetic doctor blade 711 may also comprise a permanent magnet instead of iron, thereby to form a counter magnetic pole. An AC bias or pulse bias may be applied between the sleeve 704 and the photosensitive drum 1 by means of the bias application means 712. The AC bias may preferably have a frequency of 200–4,000 Hz, and a Vpp (peak-to-peak voltage) of 500–3,000 V. In the developing position, the toner particles are transferred to an electrostatic image formed on the photosensitive drum 1 under the action of an electrostatic force due to the electrostatic image-bearing surface, and under the action of the AC bias or pulse bias.

In the above-mentioned embodiment, an elastic blade comprising an elastic or elastomeric material such as silicone rubber may also be used instead of the magnetic doctor blade 711, so that the developer is applied onto the developer-carrying member 704 while the thickness of the developer layer is regulated under pressure.

Figure 8:
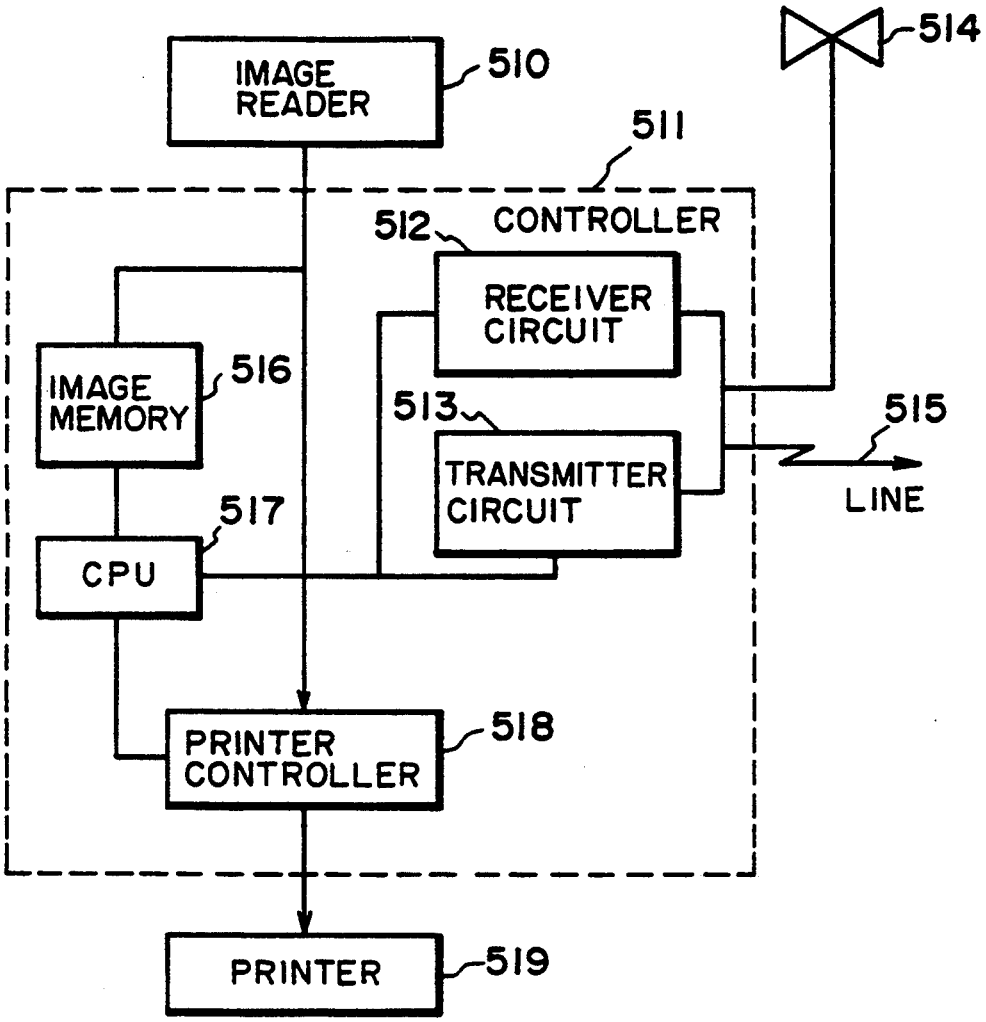
FIG. 8 is a block diagram showing a facsimile using the image forming apparatus according to the present invention as a printer.

In a case where the image forming apparatus according to the present invention is used as a printer for facsimile, the image exposure corresponds to that for printing received data. FIG. 8 shows such an embodiment by using a block diagram.

Referring to FIG. 8, a controller 511 controls an image reader (or image reading unit) 510 and a printer 519. The entirety of the controller 511 is regulated by a CPU 517. Read data from the image reader 510 is transmitted through a transmitter circuit 513 to another terminal such as facsimile. On the other hand, data received from another terminal such as facsimile is transmitted through a receiver circuit 512 to a printer 519. An image memory 516 stores prescribed image data. A printer controller 518 controls the printer 519. In FIG. 8, reference numeral 514 denotes a telephone system.

More specifically, an image received from a line (or circuit) 515 (i.e., image information received from a remote terminal connected by the line) is demodulated by means of the receiver circuit 512, decoded by the CPU 517, and sequentially stored in the image memory 516. When image data corresponding to at least one page is stored in the image memory 516, image recording is effected with respect to the corresponding page. The CPU 517 reads image data corresponding to one page from the image memory 516, and transmits the decoded data corresponding to one page to the printer controller 518. When the printer controller 518 receives the image data corresponding to one page from the CPU 517, the printer controller 518 controls the printer 519 so that image data recording corresponding to the page is effected. During the recording by the printer 519, the CPU 517 receives another image data corresponding to the next page.

Thus, receiving and recording of an image may be effected by means of the apparatus shown in FIG. 8 in the above-mentioned manner.

The present invention will be explained in more detail with reference to Examples, by which the present invention is not limited at all. In the following formulations, parts are parts by weight.

EXAMPLE 1 (Reference)

| | |
|---|---|
| Styrene-butyl acrylate divinylbenzene copolymer (copolymerization wt. ratio = 84/15.5/0.5, weight-average molecular weight = $25 \times 10^4$) | 100 wt. parts |
| Magnetite (average particle size = 0.2 micron) | 100 wt. parts |
| Low-molecular weight ethylene-polypropylene copolymer (weight-average molecular weight = 10,000) | 3 wt. parts |
| Chromium complex of monoazo dye (Spiron Black TRH, mfd. by Hodogaya Kagaku) | 0.5 wt. parts |

The above components were well blended by a blender and melt-kneaded by means of a two-axis extruder heated up to 130° C. Incidentally, when the set temperature was too high at this time, a magnetic toner easily causing fog could be obtained.

The above-mentioned kneaded product, after cooling, was coarsely Crushed by means of a cutter mill, and then finely pulverized by means of a micro-pulverizer using jet air stream. The finely pulverized product was classified by means of a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain an insulating magnetic toner (A) having a volume-average particle size of 6.5 microns. When the thus obtained magnetic toner (A) was mixed with iron powder carrier and thereafter the triboelectric charge thereof was measured, it was provided with negative charge.

The number-basis distribution and volume-basis distribution of the thus obtained magnetic toner (A) was measured by means of a Coulter counter Model TA-II with a 100 micron-aperture in the above-described manner. The thus obtained results are shown in Table 1 appearing hereinafter.

To 100 parts of the negatively chargeable insulating magnetic toner, 1.3 parts of dry-process silica fine powder (BET specific surface area=200 $m^2/g$, water-wettability=97%) treated with hexamethyldisilazane and silicone oil was added and mixed by means of a Henschel mixer, thereby to obtain a one-component-type negatively chargeable magnetic developer.

The resultant developer was charged in a modification of a commercially available copying machine (trade name: FC-5, mfd. by Canon K.K.) comprising a 30 mm-diameter negatively chargeable laminate-type photosensitive member (drum) comprising an OPC (organic photoconductor), wherein a transfer material is separated from the photosensitive member on the basis of the curvature thereof. The copying machine used herein was modified so that it effected reversal development and a transfer device comprising a transfer roller as shown in FIG. 2 was assembled therein.

The transfer roller used herein had a surface rubber portion having a rubber hardness of 27 degrees according to JIS-A (JIS K 6301-1975), and comprised an electroconductive elastic layer comprising EPDM and electroconductive carbon dispersed therein, and having a volume resistivity of $10^8$ ohm.cm. Further, with respect to transfer conditions used herein, a transfer current of 1 μA, a transfer voltage of +2000 V and a contact pressure of 50 g/cm were used.

In the above image formation, the photosensitive drum was subjected to primary charging of −700 V, the clearance between the photosensitive drum and a developing drum (containing therein a magnet) was so controlled that the developer layer formed on the developing drum did not contact the photosensitive drum, and an AC bias (frequency=1800 Hz, Vpp=1600 V) and a DC bias ($V_{DC}$=−500 V) were applied to the developing drum. The resultant developed image was fixed to a transfer material by fixing means comprising a heating pressure roller.

The thus obtained fixed toner images were evaluated in the following manner.

(1) Image density 1000 sheets of ordinary plain paper (75 g/m$^2$) for a copying machine were passed through the above-mentioned copying machine, and the image density at the time of copy of 1000 sheets was evaluated.

o (Excellent): Image density was 1.35 or higher.

Δ (Good): Image density was 1.0 to 1.34.

x (Not good): Image density was below 1.0.

(2) Transfer state

Figure 1A:
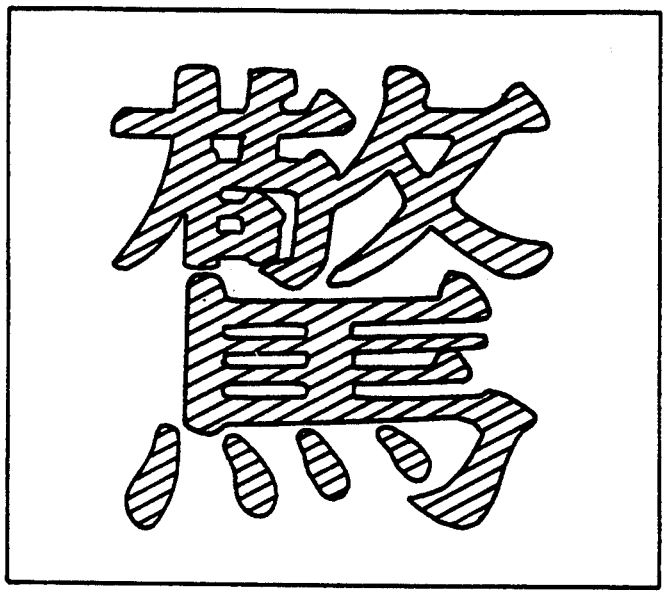
FIGS. 1A and 1C are schematic views for illustrating toner images showing a good transfer state.

Thick paper (120 g/m$^2$) as a more severe transfer condition was passed through the copying machine, and the resultant transfer failure (or transfer dropout) was evaluated.

o: The resultant image was good as shown in FIG. 1A.

Figure 1B:
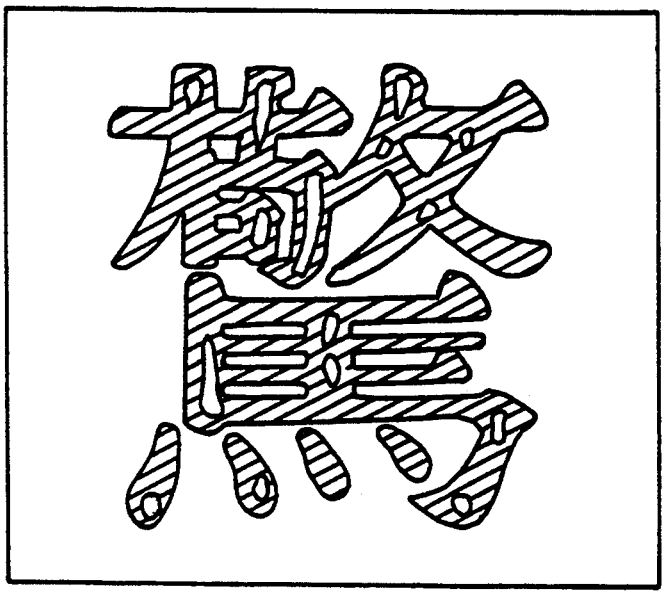
FIGS. 1B and 1D are schematic views for illustrating toner images showing a poor transfer state.

Δ: The resultant image was acceptable for practical use.

x: The resultant image was not good as shown in FIG. 1B.

(3) Paper-conveying state 1000 sheets of thin paper (50 g/m$^2$) were passed through the copying machine and the occurrence of conveyance failure such as oblique movement was evaluated.

o: The number of occurrences of the conveyance failure was one or below, per passage of 1000 sheets.

Δ: The number of occurrences of the conveyance failure was 2 to 4, per passage of 1000 sheets.

x: The number of occurrences of the conveyance failure was five or more per passage of 1000 sheets.

(4) Image quality

Scattering of toner particles, coarsening, etc., in the resultant image were evaluated with naked eye.

o: Good.

Δ: Acceptable for practical use. x: Not acceptable for practical use.

(5) Thin-line reproducibility

The reproducibility of a latent image in the form of a lateral lines having a width of 50 microns was evaluated.

o: Good.

Δ: Acceptable for practical use.

x: Not acceptable for practical use.

Hereinbelow, the multi-division classifier and the classification step used in this instance are explained with reference to FIGS. 4 and 5.

Figure 5:
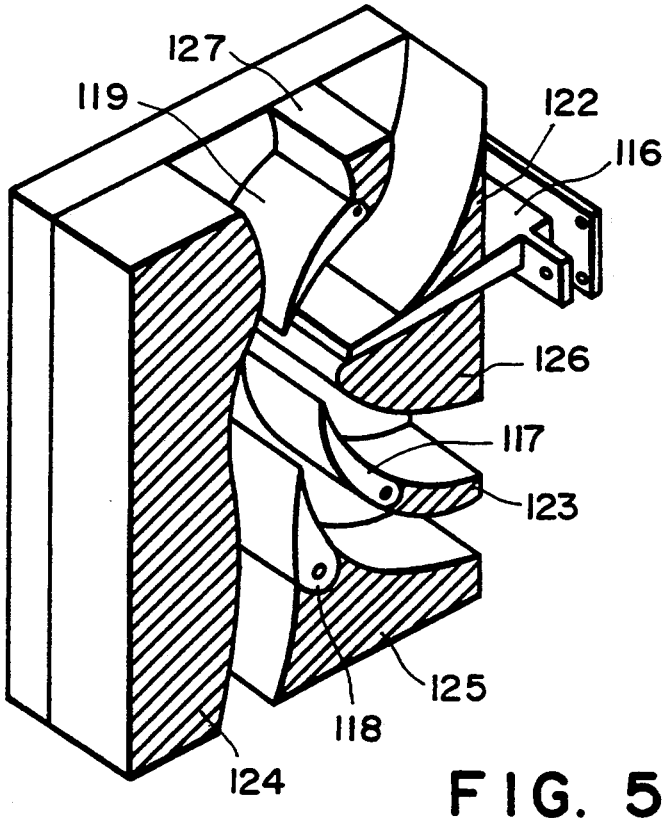

Referring to FIGS. 4 and 5, the multi-division classifier 101 has side walls 122, 123 and 124, and a lower wall 125. The side wall 123 and the lower wall 125 are provided with knife edge-shaped classifying wedges 117 and 118, respectively, whereby the classifying chamber is divided into three sections. At a lower portion of the side wall 122, a feed supply nozzle 116 opening into the classifying chamber is provided. A Coanda black 126 is disposed along the lower tangential line of the nozzle 116 so as to form a long elliptic arc shaped by bending the tangential line downwardly. The classifying chamber has an upper wall 127 provided with a knife edge-shaped gas-intake wedge 119 extending downwardly. Above the classifying chamber, gas-intake pipes 114 and 115 opening into the classifying chamber are provided. In the intake pipes 114 and 115, a first gas introduction control means 120 and a second gas introduction control means 121, respectively, comprising, e.g., a damper, are provided; and also static pressure gauges 128 and 129 are disposed communicatively with the pipes 114 and 115, respectively. At the bottom of the classifying chamber, exhaust pipes 111,112 and 113 having outlets are disposed corresponding to the respective classifying sections and opening into the chamber.

Feed powder to be classified is introduced into the classifying zone through the supply nozzle 116 under reduced pressure. The feed powder thus supplied are caused to fall along curved lines 130 due to the Coanda effect given by the Coanda block 126 and the action of the streams of high-speed air, so that the feed powder is classified into coarse powder 111, black fine powder (magnetic toner) 112 having prescribed volume-average particle size and particle size distribution, and ultra-fine powder 113.

EXAMPLE 2 (Reference)

Image formation was effected in the same manner as in Example except for using 0.6 part of alumina (BET specific surface area=100 m$^2$/g) treated with silicone varnish as an additive to be mixed with the insulating magnetic toner (A); and 1.0 part of hydrophobic silica fine powder obtained by treating dry-process silica fine powder having a BET specific surface area of 300 m$^2$/g with hexamethyldisilazane.

The results are shown in Table 2 appearing hereinafter.

EXAMPLE 3 (Reference)

Image formation was effected in the same manner as in Example 1 except for using a transfer condition of 5 g/cm.

The results are shown in Table 2 appearing hereinafter.

EXAMPLE 4 (Reference)

Image formation was effected in the same manner as in Example 1 except for using 80 wt. parts of magnetite, a magnetic toner (B) having a particle size distribution shown in Table 1, and 0.8 part of hydrophobic dry-process silica fine powder treated with hexamethyldisilazane and dimethylsilicone oil.

The results are shown in Table 2 appearing hereinafter.

Comparative Example 1 (Reference)

Image formation was effected in the same manner as in Example 2 except for using no alumina treated with silicone varnish.

The results are shown in Table 2 appearing hereinafter.

Comparative Example 2 (Reference)

Image formation was effected in the same manner as in Example 1 except for using a transfer condition of 2 g/cm.

The results are shown in Table 2 appearing hereinafter.

Comparative Example 3 (Reference)

Image formation was effected in the same manner as in Example 1 except for using 60 wt. parts of magnetite, a magnetic toner (C) having a particle size distribution as shown in Table 1, and 3.5 parts of hydrophobic dry-process silica treated with hexamethyldisilazane and dimethylsilicone oil.

The results are shown in Table 2 appearing hereinafter.

Comparative Example 4 (Reference)

Image formation was effected in the same manner as in Example 1 except for using 140 wt. parts of magnetite, a magnetic toner (D) having a particle size distribution as shown in Table 1, and 4.4 parts of fine powder.

The results are shown in Table 2 appearing hereinafter. The developer of this instance showed considerably poor fixing property.

TABLE 1

| | Volume-average particle size (μm) | % by number of particles ≦5 μm | % by volume of particles ≧12.7 μm | % by number of particles 6.35–10.08 μm | (% by numer)/(% by volume) of particles ≦5 μm | True density | $\sigma_r$ (emu/g) | $\sigma_s$ (emu/g) | Hc (Öe) |
|---|---|---|---|---|---|---|---|---|---|
| Magnetic toner A | 6.45 | 47.5 | 0 | 22.0 | 2.25 | 1.66 | 2.5 | 37 | 50 |
| Magnetic toner B | 7.8 | 29.8 | 0 | 44.0 | 3.70 | 1.66 | 2.5 | 37 | 50 |
| Magnetic toner C | 11.60 | 8.0 | 3.4 | 50 | 23.0 | 1.42 | 2.0 | 34 | 45 |
| Magnetic toner D | 4.0 | 91.0 | 0 | 2.0 | 1.15 | 1.82 | 3.2 | 47 | 51 |

TABLE 2

| | Image density | Transfer state | Paper conveyance state | Image quality | Thin-line reproducibility |
|---|---|---|---|---|---|
| Example 1 | ○ | ○ | ○ | ○ | ○ |
| Example 2 | ○ | ○ | ○ | ○ | ○ |
| Example 3 | ○ | ○ | Δ | ○ | ○ |
| Example 4 | ○ | ○ | ○ | ○ | ○Δ |
| Comp. Example 1 | Δ | x | ○ | ○ | ○ |
| Comp. Example 2 | ○ | ○ | x | Δ | ○ |
| Comp. Example 3 | ○ | ○ | ○ | Δ | x |
| Comp. Example 4 | Δ | ○ | ○ | x | ○ |

EXAMPLE 5 (Reference)

| | |
|---|---|
| Styrene-butyl acrylate copolymer (copolymerization weight ratio = 8:2) | 100 wt. parts |
| Magnetic material (magnetite) | 60 wt. parts |
| Release agent (polypropylene wax) | 3 wt. parts |
| Chromium complex of monoazo dye (charge controller) | 1 wt. parts |

The above components were melt-kneaded by means of a two-axis extruder heated up to 160° C., and the kneaded product, after cooling, was coarsely crushed by means of a hammer mill (mechanical pulverizer) so that the resultant product passed through a mesh having an opening diameter of 2 mm, and then finely pulverized by means of a jet mill (wind-force pulverizer) so as to provide a particle size of about 10 microns.

The finely pulverized product was classified by means of a DS-classifier (wind-force classifier) so that the classified product had a volume-average particle size of 11.5 microns measured by a Coulter counter, thereby to obtain a negatively chargeable insulating magnetic toner.

When the thus obtained insulating magnetic toner was mixed with iron powder carrier and thereafter the triboelectric charge thereof was measured according to the blow-off method, it showed a value of −13 μC/g.

Separately, 100 parts of silicic acid fine powder (Aerosil #200, mfd. by Nihon Aerosil K.K.) having a specific surface area of 200 $m^2/g$ was treated with 20 parts of hexamethyldisilazane (HMDS), and then treated with a solution obtained by diluting 10 parts of dimethylsilicone oil (trade name: KF-96, 100 cs, mfd. by Shinetsu Kagaku) with a solvent. The resultant mixture was dried and heat-treated at about 250° C., thereby to obtain silicic fine powder) which had been treated with hexamethyldisilazane and thereafter treated with dimethylsilicone oil.

To 100 parts of the above-mentioned insulating magnetic toner, 0.8 wt. part of the treated silicic acid powder was added and mixed by means of a Henschel mixer, thereby to obtain a one-component type magnetic developer.

The resultant developer was charged in a modification of a commercially available copying machine (trade name: FC-5, mfd. by Canon K.K.) comprising 30 mm-diameter negatively chargeable laminate-type photosensitive member (drum) comprising an OPC (organic photoconductor), and a surface layer comprising polycarbonate. The copying machine used herein was modified so that it effected reversal development and a transfer means comprising a transfer roller as shown in FIG. 1 was assembled therein.

The transfer roller used herein had a surface rubber portion having a rubber hardness of 27 degrees. Further, with respect to transfer conditions used herein, a transfer current of 1 μA, and a contact pressure of 50 g/cm were used.

In the above image formation, the photosensitive drum was subjected to primary charging of −700 V, the clearance between the photosensitive drum and a developing drum (containing therein a magnet) was set to about 300 microns so that the developer layer formed on the developing drum did not contact the photosensitive drum, and an AC bias (frequency=1800 Hz, Vpp (peak-to-peak voltage)=1600 V) and a DC bias ($V_{DC}$=−500 V) were applied to the developing drum. The resultant developed image was fixed to a transfer material by a fixing means comprising a heating pressure roller.

The thus obtained fixed toner images were evaluated in the following manner. The results are shown in Table 3 appearing hereinafter.

(1) Image density 1000 sheets of ordinary plain paper (75 g/m$^2$) for a copying machine were passed through the copying machine, and the image density at the time of copy of 1000 sheets was evaluated.

o (Excellent): Image density was 1.35 or higher.

Δ (Good): Image density was 1.0 to 1.34.

x (Not good): Image density was below 1.0.

(2) Transfer state

Figure 1C:
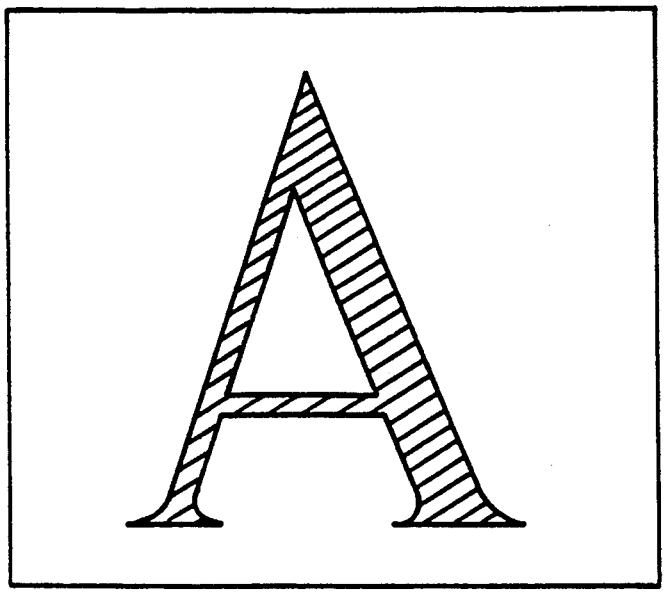

Each of thick paper (120 g/m$^2$) and a film for OHP (overhead projector) as a more severe transfer condition was passed through the copying machine, and the resultant transfer failure (or transfer dropout) was evaluated.

o: The resultant image was good as shown in FIGS. 1A or 1C.

Figure 1D:
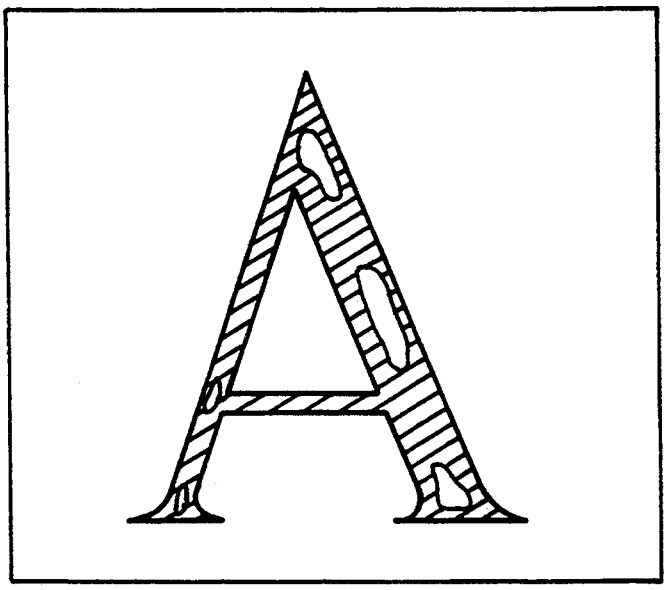

Δ: The resultant image was acceptable for practical use.

x: The resultant image was not good as shown in FIGS. 1B or 1D.

(3) Paper-conveying state 1000 sheets of thin paper (50 g/m$^2$) were passed through the copying machine and the occurrence of conveyance failure such as oblique movement was evaluated.

o: The number of occurrences of the conveyance failure was one or below, per passage of 1000 sheets.

Δ: The number of occurrences of the conveyance failure was 2 to 4, per passage of 1000 sheets.

x: The number of occurrences of the conveyance failure was five or more, per passage of 1000 sheets.

(4) Image quality

Scattering of toner particles, coarsening, etc., in the resultant image were evaluated with naked eye.

o: Good.

Δ: Acceptable for practical use.

x: Not acceptable for practical use.

EXAMPLE 6 (Reference)

100 parts of silicic acid fine powder (Aerosil #200, mfd. by Nihon Aerosil K.K.) was treated with a solution obtained by diluting 20 parts of dimethylsilicone oil (trade name: KK-96) with a solvent. The resultant mixture was dried and heat-treated at about 280° C., thereby to obtain treated silica.

Image formation was effected in the same manner as in Example 5 except for using the above-mentioned treated silica.

The results are shown in Table 3 appearing hereinafter.

EXAMPLE 7 (Reference)

Image formation was effected in the same manner as in Example 6 except that silicic acid fine powder having a specific surface area of 130 m$^2$/g was used and 100 parts of the fine powder was treated with 27 parts of silicone oil.

The results are shown in Table 3 appearing hereinafter.

EXAMPLE 8 (Reference)

Image formation was effected in the same manner as in Example 5 except for using a transfer condition of 5 g/cm.

The results are shown in Table 3 appearing hereinafter.

EXAMPLE 9 (Reference)

Image formation was effected in the same manner as in Example 6 except for using α-alumina (average particle size=0.020 micron, BET specific surface area=100 m$^2$/g) as a base material of the fine powder.

The results are shown in Table 3 appearing hereinafter.

EXAMPLE 10 (Reference)

Image formation was effected in the same manner as in Example 5 except that the addition amount of the treated fine powder was 2 wt. parts.

The results are shown in Table 3 appearing hereinafter.

EXAMPLE 11 (Reference)

Image formation was effected in the same manner as in Example 6 except for using silicic acid fine powder having a specific surface area of 300 m$^2$/g and an average particle size of 0.008 micron and 4 parts of silicone oil.

The results are shown in Table 3 appearing hereinafter.

EXAMPLE 12 (Reference)

Image formation was effected in the same manner as in Example 5 except for using a transfer condition of 20 g/cm.

The results are shown in Table 3 appearing hereinafter.

EXAMPLE 13 (Reference)

Image formation was effected in the same manner as in Example 5 except that the addition amount of the treated fine powder was 0.2 wt. parts.

The results are shown in Table 3 appearing hereinafter.

Comparative Example 5 (Reference)

Image formation was effected in the same manner as in Example 5 except for using untreated silicic acid fine powder instead of the treated silicic acid fine powder.

The results are shown in Table 3 appearing hereinafter.

Comparative Example 6 (Reference)

Image formation was effected in the same manner as in Example 5 except for using a transfer condition of 2 g/cm.

The results are shown in Table 3 appearing hereinafter.

Comparative Example 7 (Reference)

Image formation was effected in the same manner as in Example 5 except that the addition amount of the treated fine powder was 4 wt. parts.

The results are shown in Table 3 appearing hereinafter.

TABLE 3

| | (1) Image density | (2) Transfer state | | (3) Paper conveyance state | (4) Image quality |
|---|---|---|---|---|---|
| | | Thick paper | OHP | | |
| Example 5 | o | o | o | o | o |
| Example 6 | o | o | o | o | Δ |

TABLE 3-continued

| | (1) Image density | (2) Transfer state Thick paper | OHP | (3) Paper conveyance state | (4) Image quality |
|---|---|---|---|---|---|
| Example 7 | ○ | ○ | ○ | ○ | Δ |
| Example 8 | ○ | ○ | ○ | ○ | ○ |
| Example 9 | Δ | Δ | Δ | ○ | Δ |
| Example 10 | Δ | ○ | ○ | ○ | ○ |
| Example 11 | ○ | ○ | ○ | ○ | Δ |
| Example 12 | ○ | ○ | ○ | ○ | ○ |
| Example 13 | ○ | ○ | ○ | ○ | ○ |
| Comp. Example 5 | Δ | x | x | ○ | x |
| Comp. Example 6 | ○ | Δ | x | x | x |
| Comp. Example 7 | x | Δ | x | ○ | Δ |

EXAMPLE 14

| | |
|---|---|
| Styrene-butyl acrylate copolymer (copolymerization weight ratio = 8:2) | 100 wt. parts |
| Magnetic material (magnetite) | 60 wt. parts |
| Release agent (polypropylene wax) | 3 wt. parts |
| Nigrosine dye (charge controller) | 1 wt. parts |

The above components were melt-kneaded by means of a two-axis extruder heated up to 160° C., and he kneaded product, after cooling, was coarsely crushed by means of a hammer mill (mechanical pulverizer) so that the resultant product passed through a mesh having an opening diameter of 2 mm, and then finely pulverized by means of a jet mill (wind-force pulverizer) so as to provide a particle size of about 10 microns.

The finely pulverized product was classified by means of a DS-classifier (wind-force classifier) so that the classified product had a volume-average particle size of 12.0 microns measured by a Coulter counter, thereby to obtain a positively chargeable insulating magnetic toner.

When the thus obtained insulating magnetic toner was mixed with iron powder carrier and thereafter the triboelectric charge thereof was measured according to the blow-off method, it showed a triboelectric charge amount of +11 μC/g.

Separately, 100 parts of silicic acid fine powder (average particle size=0.016 micron) having a specific surface area of 130 $m^2/g$ was treated with 20 parts of amino-modified silicone oil having an amine value of 700, thereby to obtain treated fine powder.

To 100 parts of the insulating magnetic toner, 0.8 part of the treated silica fine powder was added and mixed by means of a Henschel mixer, thereby to obtain a one-component type developer.

The resultant developer was charged in a modification of a commercially available copying machine (trade name: FC-5, mfd. by Canon K.K.) comprising 30 mm-diameter negatively chargeable laminate-type photosensitive member (drum) comprising an OPC (organic photoconductor). The copying machine used herein was modified so that a transfer device comprising a transfer roller as shown in FIG. 1 was assembled therein.

The transfer roller used herein had a surface rubber portion having a rubber hardness of 27 degrees. Further, with respect to transfer conditions used herein, a transfer current of 1 μA, a transfer voltage of −2000 V, and a contact pressure of 50 g/cm were used.

In the above image formation, the photosensitive drum was subjected to primary charging of −700 V, the clearance between the photosensitive drum and a developing drum (containing therein a magnet) was so set that the developer layer formed on the developing drum did not contact the photosensitive drum, and an AC bias (frequency=1800 Hz, Vpp=1600 V) and a DC bias ($V_{DC}$=−300 V) were applied to the developing drum by a normal developing method. The resultant developed image was fixed to a transfer material by fixing means comprising a heating pressure roller.

The thus obtained fixed toner images were evaluated in the same manner as described above. The results are shown in Table 4 appearing hereinafter.

EXAMPLE 15

Image formation was effected in the same manner as in Example 14 except that 100 parts of the fine powder was treated with 35 parts of amino-modified silicone oil.

The results are shown in Table 4 appearing hereinafter.

EXAMPLE 16

Image formation was effected in the same manner as in Example 14 except for using a transfer condition of 5 g/cm.

The results are shown in Table 4 appearing hereinafter.

EXAMPLE 17 (Comparative)

Image formation was effected in the same manner as in Example 14 except for using α-alumina fine powder (average particle size=0.020 micron, BET specific surface area=100 $m^2/g$) as a base material of the fine powder.

The results are shown in Table 4 appearing hereinafter.

EXAMPLE 18

Image formation was effected in the same manner as in Example 14 except that the addition amount of the treated fine powder was 2 wt. parts.

The results are shown in Table 4 appearing hereinafter.

EXAMPLE 19

Image formation was effected in the same manner as in Example 14 except that silicic acid fine powder (average particle size=0.008 micron) having a specific surface area of 300 $m^2/g$ was used and 100 parts of the fine powder was treated with 5 parts of amino-modified silicone oil.

The results are shown in Table 4 appearing hereinafter.

EXAMPLE 20

Image formation was effected in the same manner as in Example 14 except for using a transfer condition of 20 g/cm.

The results are shown in Table 4 appearing hereinafter.

EXAMPLE 21 (Comparative)

Image formation was effected in the same manner as in Example 14 except that the addition amount of the treated fine pwoder was 0.2 wt. part.

The results are shown in Table 4 appearing hereinafter.

Comparative Example 8

Image formation was effected in the same manner as in Example 14 except for using silicic acid fine powder treated with aminopropyltriethoxysilane.

The results are shown in Table 4 appearing hereinafter.

Comparative Example 9

Image formation was effected in the same manner as in Example 14 except for using a transfer condition of 2 g/cm.

The results are shown in Table 4 appearing hereinafter.

Comparative Example 10

Image formation was effected in the same manner as in Example 14 except that the addition amount of the treated fine powder was 4 wt. parts.

The results are shown in Table 4 appearing hereinafter.

TABLE 4

| | (1) Image density | (2) Transfer state | (3) Paper conveyance state | (4) Image quality |
|---|---|---|---|---|
| Example 14 | ○ | ○ | ○ | ○ |
| Example 15 | ○ | ○ | ○ | ○ |
| Example 16 | ○ | ○ | Δ | ○ |
| Example 17 | Δ | ○ | ○ | Δ |
| Example 18 | ○ | ○ | ○ | ○ |
| Example 19 | ○ | ○ | ○ | ○ |
| Example 20 | ○ | ○ | ○ | ○ |
| Example 21 | ○ | ○ | ○ | ○ |
| Comparative Example 8 | x | Δ | ○ | Δ |
| Comparative Example 9 | ○ | Δ | x | x |
| Comparative Example 10 | x | Δ | ○ | Δ |

What is claimed is:

1. An image forming method comprising:

(a) developing an electrostatic image formed on an electrostatic image-bearing member with a developer to form thereon a developed image, said developer comprising 100 wt. parts of a toner and 0.3 to 1.6 wt. parts of silica fine powder treated with a silicone material selected from the group consisting of an amino-modified silicone oil and an amino-modified silicone varnish; and (b) electrostatically transferring the developed image on the electrostatic image-bearing member to a transfer material while pressing a transfer means supplied with a bias voltage against the electrostatic image-bearing member with the transfer material disposed between the electrostatic image-bearing member and the transfer means under a line pressure of 3 g/m or higher, wherein the electrostatic image-bearing member has a curvature radius of no greater than 25 mm at the transfer position.

2. A method according to claim 1, wherein the developer comprises:

(i) an insulating magnetic toner; and (ii) the silica fine powder treated with the silicone material.

3. A method according to claim 1, wherein the developer is carried on a developing sleeve and is triboelectrically charged by the contact thereof with the developing sleeve.

4. A method according to claim 1, wherein the transfer means comprises a device selected from the group consisting of a transfer roller and a transfer belt.

5. A method according to claim 4, wherein the transfer means comprises a transfer roller comprising a metal core and an electroconductive elastic layer disposed thereon.

6. A method according to claim 5, wherein the electroconductive elastic layer of the transfer roller has a volume resistivity of $10^6$ to $10^8$ ohm.cm.

7. A method according to claim 1, wherein the developed image is electrostatically transferred to the transfer material while the transfer means is pressed against the electrostatic image-bearing member under a line pressure of 20 g/cm or higher.

8. A method according to claim 1, wherein the developed image is electrostatically transferred to the transfer material by the transfer means to which a bias having a transfer current of 0.1–50 μA, and a transfer voltage of 500–4000 V (absolute value) is applied.

9. A method according to claim 1, wherein 100 wt. parts of the fine powder has been treated with 1–35 wt. parts of the amino-modified silicone oil.

10. A method according to claim 1, wherein 100 parts of the fine powder has been treated with 2–30 wt. parts of the amino-modified silicone oil.

11. A method according to claim 1, wherein the silica fine powder is obtained by treating a silica fine powder having a particle size of 0.001–2 microns with said silicone material.

12. A method according to claim 1, wherein the silica fine powder has been treated with a silane coupling agent and the silicone material.

13. A method according to claim 1, wherein the insulating magnetic toner has a residual magnetization ar of 1–5 emu/g, a saturation magnetization $\sigma_s$ of 15–50 emu/g, and a coercive force of 20–100 Öe.

14. A method according to claim 1, wherein the toner comprises an insulating magnetic toner, and the insulating magnetic toner (1) contains 17–60% by number of magnetic toner particles having a particle size of 5 microns or smaller, (2) contains 5–50% by number of magnetic toner particles having a particle size of 6.35–10.08 microns, and (3) contains 2.0% by volume or less of magnetic toner having a particle size of 12.7 microns or larger; wherein (a) the magnetic toner has a volume-average particle size of 6–8 microns, and (b) the magnetic toner particles having a particle size of 5 microns or smaller have a particle size distribution satisfying the following formula:

$$N/V = -0.05N + k$$

wherein N is a positive number of 17 to 60 that denotes the percentage by number of magnetic toner particles having a particle size of 5 microns or smaller, V denotes the percentage by volume of magnetic toner particles having a particle size of 5 microns or smaller, and k denotes a positive number of 4.6 to 6.7.

15. A method according to claim 1, wherein the silica fine powder has been treated with an amino-modified silicone oil represented by the following formula:

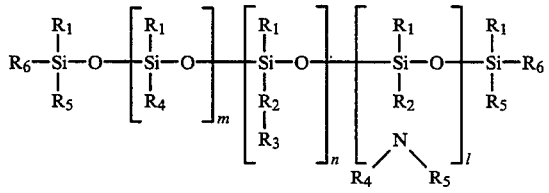

wherein $R_1$ and $R_6$ are each a hydrogen atom, an alkyl group, an aryl group, an alkoxy group, an alkyl group having an amino group, an aryl group having an amino group, an alkyl group having a halogen atom or an aryl group having a halogen atom;

$R_2$ is an optional group selected from the group consisting of an alkylene group, a phenylene group, an alkylene group having an amino group, a phenylene group having an amino group, an alkylene group having a halogen atom and a phenylene group having a halogen atom;

$R_3$ is a nitrogen-containing heterocycle or a group having a heterocyclic structure;

$R_4$ and $R_5$ are each a hydrogen atom, an alkyl group or an aryl group;

m is a number of 1 or larger;

n and 1 are each 0 or a positive number; and the sum of (n+1) is a positive number of 1 or larger.

16. A method according to claim 1, wherein the silica fine powder has been treated with an amino-modified silicone varnish including a chemical structure represented by the following formula:

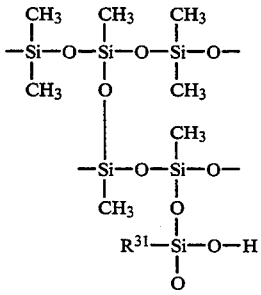

wherein $R^{31}$ is a methyl or phenyl group.

17. A method according to claim 1, wherein the toner comprises an insulating magnetic toner and the insulating magnetic toner contains:

(1) 71–60% by number of magnetic toner particles having a particle size of 5 microns or smaller; and (2) 5–50% by number of magnetic toner particles having a particle size of 6.35–10.08 microns.

18. A method according to claim 1, wherein the toner comprises an insulating magnetic toner and the insulating magnetic toner contains:

(1) 17–60% by number of magnetic toner particles having a particle size of 5 microns or smaller; and (2) 5–50% by number of magnetic toner particles having a particle size of 6.35–10.08 microns; wherein the magnetic toner particles having a particle size of 5 microns or smaller have a particle size distribution satisfying the following formula:

$$N/V = -0.5N + k$$

wherein N is a positive number of 17 to 60 that denotes the percentage by number of magnetic toner particles having a particle size of 5 microns or smaller, V denotes the percentage by volume of magnetic toner particles having a particle size of 5 microns or smaller, and k denotes a positive number of 4.6 to 6.7.

19. A method according to claim 1, wherein the toner comprises an insulating magnetic toner and the insulating magnetic toner contains:

(1) 17–60% by number of magnetic toner particles having a particle size of 5 microns or smaller; and (2) 5–50% by number of magnetic toner particles having a particle size of 6.35–10.08 microns; wherein (a) the magnetic toner has a volume-average particle size of 6–8 microns; and (b) the magnetic toner particles having a particle size of 5 microns or smaller have a particle size distribution satisfying the following formula:

$$N/V = -0.5N + k,$$

wherein N is a positive number of 17 to 60 that denotes the percentage by number of magnetic toner particles having a particle size of 5 microns or smaller, V denotes the percentage by volume of magnetic toner particles having a particle size of 5 microns or smaller, and k denotes a positive number of 4.6 to 6.7.

20. A method according to claim 1, wherein the transfer means is pressed against the electrostatic image-bearing member under a line pressure of 3–80 g/cm.

* * * * *

UNITED STATES PATENT AND TRADEMARK OFFICE

CERTIFICATE OF CORRECTION

PATENT NO. : 5,392,103

DATED : February 21, 1995

INVENTOR(S) : TSUTOMU KUKIMOTO, ET AL.

It is certified that error appears in the above-indentified patent and that said Letters Patent is hereby corrected as shown below:

On the title page item,

[56] References Cited

Foreign Patent Documents, "0286879 11/1989 Japan" should read --0286879 11/1988 Japan--.

[57] Abstract

Line 5, "thereon" (second occurrence) should be deleted.

DRAWING

Figure 6:
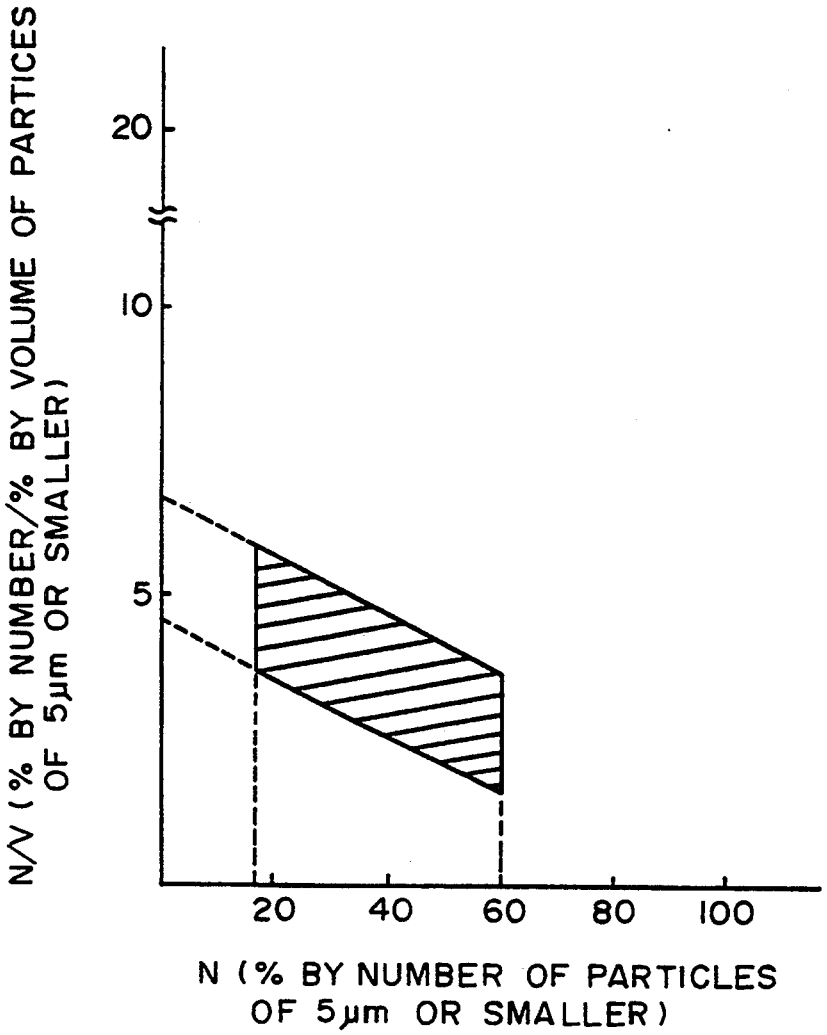
FIG. 6 is a graph showing a particle size region with respect to % by number (N)/% by volume (V) and % by number of magnetic toner particles having a particle size of 5 microns or below.

Sheet 5, Fig. 6, "PARTICES" should read --PARTICLES--.

COLUMN 1

Line 36, "to" should be deleted.

COLUMN 3

Line 40, "order-to" should read --order to--.

COLUMN 4

Line 12, "transfer" should be deleted.

COLUMN 11

Lines 8-10, should be deleted.

COLUMN 14

Line 43, "N/N = -0.05N+k," should read --N/V = -0.05N+k,--.

UNITED STATES PATENT AND TRADEMARK OFFICE

CERTIFICATE OF CORRECTION

PATENT NO. : 5,392,103

DATED : February 21, 1995

INVENTOR(S) : TSUTOMU KUKIMOTO, ET AL.

It is certified that error appears in the above-indentified patent and that said Letters Patent is hereby corrected as shown below:

COLUMN 15

Line 41, "the" should read --if the--.

COLUMN 16

Line 62, "Form" should read --From--; and

Lines 64-65, "characterizing" should read --characterize--.

COLUMN 18

Line 62, "desired" should read --desired.--.

COLUMN 19

Line 1, "another methods" should read --other methods--.

COLUMN 22

Line 28, "Crushed" should read --crushed--; and

Line 33, "power" should read --powder--.

COLUMN 23

Line 57, "use. x: not" should read --use. ¶ x: Not--.

COLUMN 29

Line 30, "he" should read --the--.

COLUMN 30

Line 60, "of20" should read --of 20--; and

UNITED STATES PATENT AND TRADEMARK OFFICE

CERTIFICATE OF CORRECTION

PATENT NO. : 5,392,103

DATED : February 21, 1995

INVENTOR(S) : TSUTOMU KUKIMOTO, ET AL.

It is certified that error appears in the above-indentified patent and that said Letters Patent is hereby corrected as shown below:

COLUMN 30, Cont'd.

Line 68, "pwoder" should read --powder--.

COLUMN 31

Line 59, "3 g/m" should read --3g/cm--.

COLUMN 32

Line 38, "ar" should read --$\delta$r--.

COLUMN 34

Line 4, "71-60%" should read --17-60%--.

Signed and Sealed this

Nineteenth Day of September, 1995

*Attest:*

Bruce Lehman

BRUCE LEHMAN

*Attesting Officer*

*Commissioner of Patents and Trademarks*